US011077926B1

(12) United States Patent
Thelen

(10) Patent No.: US 11,077,926 B1
(45) **Date of Patent: *Aug. 3, 2021**

(54) TILLER ASSIST INCLUDING HYDRAULIC DAMPER AND POWER STEERING

(71) Applicant: John P. Thelen, Otsego, MN (US)

(72) Inventor: John P. Thelen, Otsego, MN (US)

( * ) Notice: Subject to any disclaimer, the term of this patent is extended or adjusted under 35 U.S.C. 154(b) by 265 days.

This patent is subject to a terminal disclaimer.

(21) Appl. No.: 16/044,026

(22) Filed: Jul. 24, 2018

Related U.S. Application Data

(63) Continuation-in-part of application No. 15/180,071, filed on Jun. 12, 2016, now Pat. No. 10,029,774, which is a continuation-in-part of application No. 15/003,778, filed on Jan. 21, 2016, now abandoned.

(60) Provisional application No. 62/106,215, filed on Jan. 21, 2015.

(51) Int. Cl.

| | |
|---|---|
| ***B63H 20/08*** | (2006.01) |
| ***B63H 25/02*** | (2006.01) |
| ***B63H 20/12*** | (2006.01) |
| ***B63H 25/12*** | (2006.01) |
| ***F02B 61/04*** | (2006.01) |

(52) U.S. Cl.
CPC ..... *B63H 20/08* (2013.01); *B63H 20/12* (2013.01); *B63H 25/02* (2013.01); *B63H 25/12* (2013.01); *F02B 61/045* (2013.01)

(58) Field of Classification Search
CPC ..... B63H 20/08; B63H 20/12; B63H 21/265; B63H 25/02; B63H 25/12; F02B 61/045
See application file for complete search history.

(56) References Cited

U.S. PATENT DOCUMENTS

| | | | |
|---|---|---|---|
| 1,716,962 | A | 6/1929 | Johnson |
| 1,980,685 | A | 11/1934 | Johnson |
| 2,916,008 | A | 12/1959 | Bauer |

(Continued)

FOREIGN PATENT DOCUMENTS

WO WO 01/051353 A1 7/2001

OTHER PUBLICATIONS

DeJaehghere, Dan; "The Tillerman: Advantages to a tiller-driven system"; Fishing League Worldwide, Fishing_News, The_Tillerman_FLW_Fishing_News.pdf, Aug 24, 2007, http://www.flwfishing.com/tips/200-7-08-24-the-tillerman, 2 pages.

(Continued)

*Primary Examiner* — Ajay Vasudeva
(74) *Attorney, Agent, or Firm* — Albert W. Watkins

(57) ABSTRACT

A tiller assist hydraulic marine dampener and brake assembly has a fluid flow path with two potential flow restrictors in series. These include a solenoid valve and a hydraulic needle valve. A single cylinder piston serves to close both ends of the flow path. The tiller assist marine dampener and brake assembly in a second embodiment has a central coupling rod with recesses, a coupling link to a tiller arm, a co-axial tube, a nut adjacent each distal end of the co-axial tube securing the co-axial tube to a mounting bracket, a pair of springs co-axial with and surrounding the coupling rod and interior of the co-axial tube, a pair of adjustable end caps closing the gap between the ends of the co-axial tube and the coupling rod while also acting as stops for the springs, and a slide located between the pair of springs, and a set pin.

13 Claims, 16 Drawing Sheets

(56) References Cited

U.S. PATENT DOCUMENTS

| | | | | |
|---|---|---|---|---|
| 3,148,657 | A | 9/1964 | Horning | |
| 3,171,382 | A | 3/1965 | Bergstedt | |
| 3,857,357 | A | 12/1974 | Bergstedt | |
| 4,080,918 | A | 3/1978 | Bonhard | |
| 4,362,515 | A | 12/1982 | Ginnow | |
| 4,373,920 | A | 2/1983 | Hall et al. | |
| 4,391,592 | A | 7/1983 | Hundertmark | |
| 4,490,120 | A | 12/1984 | Hundertmark | |
| 5,092,801 | A | 3/1992 | McBeth | |
| 5,207,170 | A | 5/1993 | Nakahama | |
| 6,138,596 | A | 10/2000 | Gonring et al. | |
| 6,341,992 | B1 | 1/2002 | Eglinsdoerfer et al. | |
| 6,524,147 | B1 | 2/2003 | Hundertmark | |
| 6,592,414 | B2 | 7/2003 | Mineno et al. | |
| 6,598,553 | B1 | 7/2003 | Hundertmark | |
| 6,715,438 | B1 | 4/2004 | Hundertmark | |
| 6,821,168 | B1 * | 11/2004 | Fisher | B63H 25/28 114/150 |
| 7,011,558 | B2 | 3/2006 | Roos | |
| 7,056,169 | B1 | 6/2006 | Lokken et al. | |
| 7,150,664 | B1 | 12/2006 | Uppgard et al. | |
| 7,267,588 | B1 | 9/2007 | Griffiths et al. | |
| 7,325,507 | B1 | 2/2008 | Hundertmark | |
| 7,681,513 | B1 | 3/2010 | Hundertmark | |
| 8,162,706 | B2 | 4/2012 | Mizutani et al. | |
| 8,376,794 | B2 | 2/2013 | Hundertmark | |
| 10,029,774 | B1 * | 7/2018 | Thelen | B63H 20/08 |
| 2004/0040485 | A1 | 3/2004 | Hundertmark | |

OTHER PUBLICATIONS

"Whaler: Reference: Owner's Manual: Operations"; ContinuousWave; http://continuouswave.com/whaler/reference/manual9-17/operations.html; trim_tab.pdf, downloaded Nov. 25, 2013; 20 pages.

"Cylinders for Hydraulic Steering Systems, UC94-OBF Dimensions"; UFlex, Sarasota, FL; 817_uc94obfdimeng.pdf, 1 page.

"UC94-OBF: Recommeded Motors"; UFlex, Sarasota, FL; 817_uc94obffuoribordoeng.pdf, 1 page.

"UC94-OBF Front Mount Cylinder for Outboard Engines up to 150 HP Total"; uflex_outboard_hyd_steering.pdf, pp. 42, 43.

"Ultraflex 15"; Ultraflex S.p.a., Italy; ULTRAFLEX2015_2.pdf, 164 pgs.

* cited by examiner

TILLER ASSIST INCLUDING HYDRAULIC DAMPER AND POWER STEERING

CROSS REFERENCE TO RELATED APPLICATIONS

The present application is a Continuation-In-Part of U.S. patent application Ser. No. 15/180,071 filed Jun. 12, 2016 and granted as U.S. Pat. No. 10,029,774 on Jul. 24, 2018, which is a Continuation-In-Part of U.S. patent application Ser. No. 15/003,778 filed Jan. 21, 2016 and now abandoned, which in turn claims the benefit of U.S. provisional patent application 62/106,215 filed Jan. 21, 2015, each of like inventorship, the teachings and entire contents which are incorporated herein by reference. In addition to the foregoing, the teachings and content of my U.S. provisional patent application 62/649,927 filed Mar. 29, 2018 and entitled "Handle Electrically Actuated Tiller Pump" is also incorporated herein by reference in entirety.

BACKGROUND OF THE INVENTION

1. Field of the Invention

The present invention pertains generally to a steering mechanism for boats and ships. In one embodiment, the steering mechanism is altered by the flow of a fluid in a closed circuit, while in another embodiment various mechanical apparatuses are used.

2. Description of the Related Art

Steering systems for outboard marine motors have for many years incorporated tiller arms that are manually controlled by a tillerman or boat operator. One well-known problem with a tiller motor is the development of steering torque through interaction between the propellor and water. This torque will create a force tending to turn the motor to the side, away from in-line with the boat's current direction of travel. This is certainly useful in some limited circumstances, but in most cases is undesirable, and will require the tillerman to continuously apply a force counter to the torque to keep the boat traveling in a straight line or to turn opposite to the torque.

Recognizing a desire to neutralize this torque, artisans from almost a century ago devised apparatus such as tabs that can be affixed to the boat motor near to the propeller, and which deflect the water to counter steering torque. One benefit of this type of apparatus is that, as the propeller changes speed, the countering torque will also vary. Exemplary patents, the teachings and contents which are incorporated herein by reference, include: U.S. Pat. No. 1,716,962 by Johnson, entitled "Water propulsion device"; and U.S. Pat. No. 1,980,685 by Johnson, entitled "Marine motor". These types of apparatus are still in use today, and certainly offer much benefit.

However, marine motors have continued to increase in power output, and while these apparatus that deflect the water help, it is not practically possible to achieve a setting that consistently counters the torque at all speeds of propeller operation. Further, other factors will affect whether a boat travels in a straight line, such as wind and waves. Waves can create significant but short term deflection forces, while wind may create a longer term and somewhat more steady deflection in the travel of a boat. As a result, and even if the tabs and similar apparatus are set properly, the tillerman will still fatigue due to the efforts required to overcome the transient forces of the waves and the variability of the wind. Several artisans have devised mechanical systems that incorporate a resilient spring bias to assist with steering. Exemplary patents, the teachings and contents which are incorporated herein by reference, include: U.S. Pat. No. 4,362,515 by Ginnow, entitled "Marine drive vane steering system"; U.S. Pat. No. 6,341,992 by Eglinsdoerfer et al, entitled "Boat steering torque compensator"; U.S. Pat. No. 7,011,558 by Roos, entitled "Directionally-stabilized water-jet steering apparatus"; and U.S. Pat. No. 8,162,706 by Mizutani et al, entitled "Watercraft steering system, and watercraft".

Another problem with a tiller motor is the inability of the tillerman to release the tiller arm. As the boat is traveling through the water, there are many erratic forces acting upon the motor, and without a person to anchor the tiller, it will move towards port or starboard generally undesirably. Furthermore, as outboard motors increased in size, the effort required to control and steer these larger motors also increases, making the job extremely tiresome and cumbersome. This has led to the incorporation of other techniques, often taken from larger marine vessels. Among these are various cable and hydraulically controlled steering apparatus, in some cases remote from the motor and thereby even more similar to the larger marine vessel counterparts. Exemplary patents, the teachings and contents which are incorporated herein by reference, include: U.S. Pat. No. 4,373,920 by Hall et al, entitled "Marine propulsion device steering mechanism"; U.S. Pat. No. 5,092,801 by McBeth, entitled "Hydraulic steering assembly for outboard marine engines"; and U.S. Pat. No. 7,150,664 by Uppgard et al, entitled "Steering actuator for an outboard motor". These patents illustrate various techniques for coupling into the tilt tube or horizontal pivotal axis that controls the tilt of the motor relative to the transom. Since they are coupled in at this tilt axis, then the steering mechanism, which is operative about an axis generally perpendicular or transverse to the tilt axis, will follow the motor and still be operative regardless of the amount of motor tilt.

These types of steering apparatus have proved to be very well received by boaters, and implemented in many different boats. They do, however, suffer from a few drawbacks. One of these is the requirement for a hydraulic pump and associated high pressure hydraulic line, both which add cost and require maintenance. The hydraulic line will typically include at least some length of flexible rubber hose, since the motor and steering mechanism will each tilt during operation, thereby requiring flexible connection. If a leak develops, either through a failure of the flexible line or a connector, or if the pump fails, the loss of pressurized hydraulic fluid can lead to a near inability to steer the boat. While the boat may still in some cases be manually steered, in such cases this can be extremely difficult, and is typically achieved under only low speed, low power operation. In addition, these systems are typically operated from a helm. Helms are common in much larger boats and ships, and desirable since they provide a good vantage point for the captain or operator. However, in relatively smaller boats, the helm can detract from the useful space on the boat. This loss of space can be particularly disadvantageous in smaller recreational, fishing, and hunting boats.

One particularly skilled artisan has created a steering system that addresses many of the deficiencies of the prior art. Two particularly relevant patents, the teachings and contents which are incorporated herein by reference, include: U.S. Pat. No. 7,325,507 by Hundertmark, entitled "Tiller operated marine steering system"; and U.S. Pat. No.

7,681,513 by Hundertmark, entitled "Tiller operated marine steering system". These patents describe a self-contained hydraulic system that controls the flow of fluid in the system based upon relatively small forces applied to the tiller. When the tiller handle is released, the hydraulic circuit locks the motor in place, preventing unintended steering or deviation from the last position set. When the tillerman intends to alter the direction the boat is being steered, again a pressure on the tiller will unlock the steering and redirect the boat, until pressure is again released. This apparatus has provided significant benefit over the other prior art of record, and provides much relief to a tillerman. However, the intent of the system disclosed by Hundertmark is to lock the direction of steering, which like the prior art hydraulic steering systems, can lead to undesirable consequence. In the event of a failure, the Hundertmark system may lock the steering in a single direction, essentially disabling the boat.

In addition to the aforementioned patents, a number of other exemplary patents that are illustrative of the level of skill in the prior art, the teachings and contents which are incorporated herein by reference, include: U.S. Pat. No. 2,916,008 by Bauer, entitled "Steering device for small watercraft"; U.S. Pat. No. 3,148,657 by Horning, entitled "Marine propulsion and steering system"; U.S. Pat. No. 3,171,382 by Bergstedt, entitled "Propeller mechanism for boats"; U.S. Pat. No. 3,857,357 by Bergstedt, entitled "Torque compensating mechanism for boat drives"; U.S. Pat. No. 4,080,918 by Bonhard, entitled "Rudder control device"; U.S. Pat. No. 4,391,592 by Hundertmark, entitled "Hydraulic trim-tilt system"; U.S. Pat. No. 4,490,120 by Hundertmark, entitled "Hydraulic trim-tilt system"; U.S. Pat. No. 5,207,170 by Nakahama, entitled "Marine propulsion unit control system"; U.S. Pat. No. 6,524,147 by Hundertmark, entitled "Power assist marine steering system"; U.S. Pat. No. 6,598,553 by Hundertmark, entitled "Power assist marine steering system"; U.S. Pat. No. 6,715,438 by Hundertmark, entitled "Tiller operated power assist marine steering system"; U.S. Pat. No. 7,056,169 by Lokken et al, entitled "Connection device for a marine propulsion system"; U.S. Pat. No. 8,376,794 by Hundertmark, entitled "Electromechanically actuated steering vane for marine vessel"; 2004/0040485 by Hundertmark, entitled "Power assist marine steering system"; and WO 01/051353 by Brown et al, entitled "Boat steering torque compensator". In addition to the aforementioned patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, there still remains a need for a simple and economical tiller assist that offers the flexibility of either manual or power steering assist.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a tiller assist that is adapted to couple between a boat transom and a boat motor steering connector. The tiller assist has a cylinder carriage defining a cylinder passage. A cylinder piston is adapted to reciprocate within the cylinder passage, and divides the cylinder passage into first and second chambers. A first one of the cylinder carriage and cylinder piston is adapted to be affixed to the boat transom, and a second one of the cylinder carriage and cylinder piston different from the first one is adapted to be affixed to the boat motor steering connector. A first fluid path couples the first chamber to the second chamber. At least one first fluid path flow restrictor is also provided within the first fluid path intermediate between the first and second chambers and in series with the at least one normally open valve, and is configured to restrict flow through the first fluid pathway. A second fluid path couples the first chamber to second chamber. A fluid pump is provided within the second fluid path intermediate between first and second chambers and has a first inoperative state and a second state pumping a fluid through the second fluid path. At least one second fluid path flow restrictor is provided within the second fluid path and in series with the fluid pump, blocking the fluid from flowing through the second fluid path when the fluid pump is in the first inoperative state, and permitting fluid to flow through the second fluid path when the fluid pump is in the second pumping state.

In a second manifestation, the invention is a tiller assist comprises a cylinder; a piston reciprocal within the cylinder; a tilt tube coupler; a transom coupler; a first fluid path external to the cylinder; and first and second valves in series with each other within the fluid path and intermediate between the first and second cylinder ends. The cylinder has first and second distal ends. The piston is reciprocal within the cylinder intermediate to and defines a fluid seal between first and said second cylinder ends. The tilt tube coupler is adapted to securely engage an outboard motor tilt tube. The transom coupler is adapted to securely engage a boat transom. A one of the tilt tube coupler and transom coupler is secured to the cylinder, and the other of the tilt tube coupler and transom coupler is secured to the piston. The first fluid path external to the cylinder couples the first cylinder end to the second cylinder end. The first and second valves in series with each other within the first fluid path are intermediate between the first and second cylinder ends. The first and second valves are configured in a first open state when the first and second valves are both open to provide in combination with the flow path a continuous and substantially unrestricted path from first cylinder end to second cylinder end. The first and second valves are configured in a second closed state when at least one of the first and second valves are closed to interrupt the flow path between first cylinder end and said second cylinder end. The first and second valves are configured in a third flow restricted state when the first valve is open and the second valve is partially closed to restricted flow in the flow path adapted to provide countering torque to rapid position changes of a boat motor, and thereby dampen movement of the boat motor induced by waves. A second fluid path couples the first chamber to second chamber. A fluid pump is provided within the second fluid path intermediate between first and second chambers and has a first inoperative state and a second state pumping a fluid through the second fluid path. At least one second fluid path flow restrictor is provided within the second fluid path and in series with the fluid pump, blocking the fluid from flowing through the second fluid path when the fluid pump is in the first inoperative state, and permitting fluid to flow through the second fluid path when the fluid pump is in the second pumping state.

In a third manifestation, the invention is a spring and pin controlled tiller assist adapted to couple between a boat transom and a boat motor steering connector. A coupling rod terminates adjacent a first end with a boat motor steering coupling adapted to link to a boat motor steering connector.

A pair of springs are co-axial with the coupling rod. A tube encompasses the coupling rod and pair of springs. A mounting bracket supports the tube, coupling rod, and pair of springs. A pair of end caps, one at each distal end of the tube, are adjustable to change a distance between the end caps. Each one the pair of end caps acts as a stop for a one of the pair of springs. A slide extends through the tube and is located generally intermediate between each one of the pair of springs. A set pin operatively passes from externally to the slide and through, and thereby through the tube, into firm engagement with the coupling rod.

OBJECTS OF THE INVENTION

Exemplary embodiments of the present invention solve inadequacies of the prior art by providing a marine dampener/brake assembly implemented through mechanical apparatus in one embodiment, and through a hydraulic circuit in a second embodiment. In a further embodiment, the hydraulic circuit may be further augmented with a hydraulic pump and controls.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide great ability to vary, adjust and control the forces generated by the tiller assist to meet the varying needs of a tillerman, helmsman, or operator. A second object of the invention is to allow the tillerman to selectively lock the tiller in a particular position. Another object of the present invention is to allow the tillerman to introduce controlled resistance to movement of the tiller. A further object of the invention is to provide a simple mechanical system capable of achieving the foregoing objectives. Yet another object of the present invention is to provide a simple hydraulic system capable of achieving the foregoing objectives. An additional object of the present invention is to provide a system that is unlikely to fail, but in the event it fails, this occurs in a safe manner that allows full manual control of the tiller. Another object of the invention is to further augment the hydraulic circuit with a hydraulic pump and controls to selectively enable optional full power steering.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
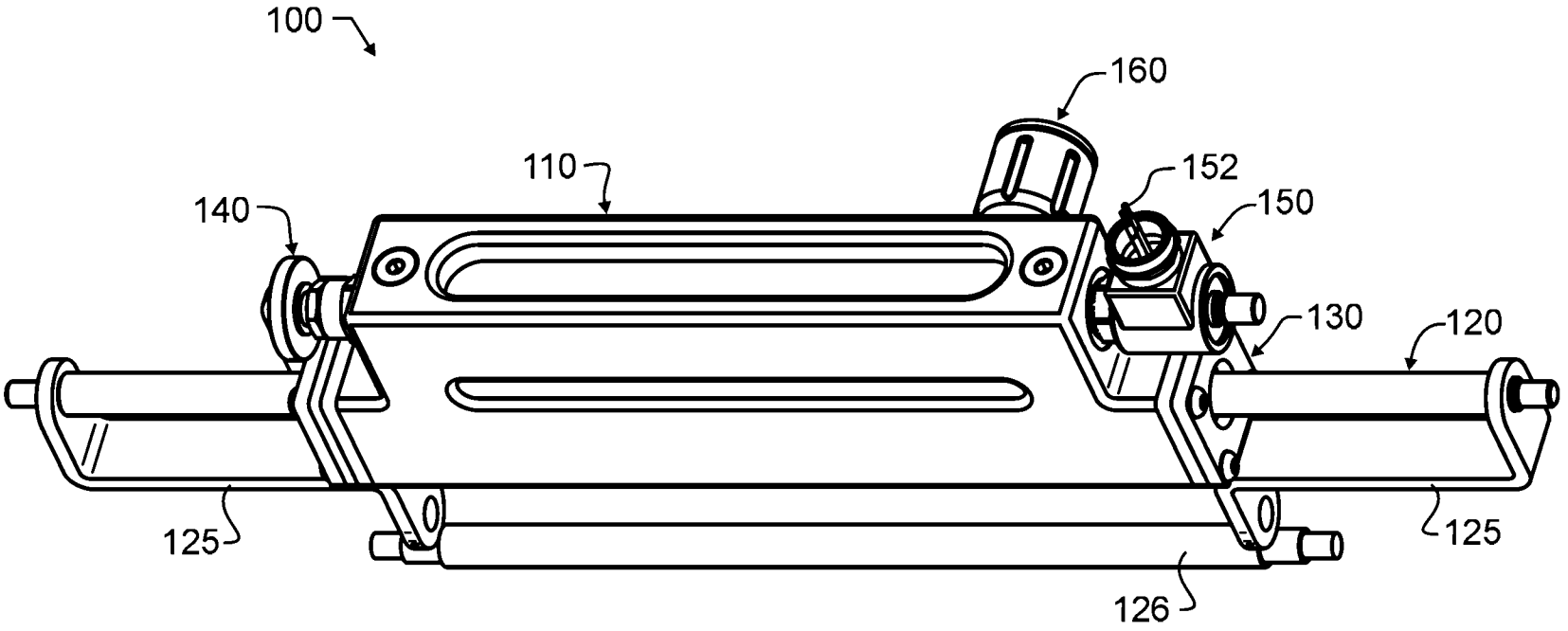
FIG. 1 illustrates a preferred embodiment tiller assist designed in accord with the teachings of the present invention from a front and bottom projected view.

Manifested in the preferred embodiment, the present invention provides a closed loop hydraulic tiller assist that enables a tillerman to selectively introduce controlled resistance to movement of the tiller. In addition, the tillerman may selectively lock the tiller in a particular position. In an alternative embodiment, the tillerman may further selectively engage a power steering system to replace manual steering.

FIGS. 1-8 illustrate a preferred embodiment tiller assist 100. In this embodiment, the functions of the tiller assist are implemented through a hydraulic marine dampener/brake assembly. A cylinder carriage 110 is configured to travel in a reciprocating manner along rod/piston assembly 120. Cylinder carriage 110 acts as the primary housing within which various components are inserted, and also as a hydraulic reservoir with pre-fabricated fluid passages.

A pair of cylinder head assemblies 130 provide working seals that retain the working fluid within cylinder carriage 110 even as cylinder carriage 110 reciprocates. In addition, cylinder head assemblies 130 also act as linear bearings, guiding rod/piston assembly 120 precisely down the center of a central bore 112 in cylinder carriage 110. A set of bolts or other suitable fasteners 116 may be provided to secure the cylinder head assemblies 130 to cylinder carriage 110.

A hydraulic needle valve 140 and solenoid valve 150 are coupled to and preferably externally accessible on cylinder carriage 110. These two valves 140, 150 also extend internally within cylinder carriage 110 into a closed loop fluid flow path therein, and are configured to selectively control the flow of working hydraulic fluid through the closed loop fluid flow path as will be described more fully herein below.

A pair of compact extreme-pressure threaded-fitting plugs 115 may be used to provide access to fill the open voids within cylinder carriage 110 with suitable hydraulic fluid. Additionally, an optional accumulator 160 may be provided that serves to receive excess fluid from the fluid flow path, and return fluid thereto, depending upon temperature and fill levels.

Preferred embodiment tiller assist 100 is preferably anchored to a fixed boat hull location, such as the transom, through mounting brackets 125. This means that rod/piston assembly 120 is also anchored relative to the transom. Cylinder carriage 110 is mounted to the motor steering assembly through steering linkage 170. Consequently, steering movements of the motor require movement of cylinder carriage 110 relative to rod/piston assembly 120.

Preferred embodiment tiller assist 100 may be mounted to a boat and motor in a number of different ways, depending upon the features available in the motor and tiller. A preferred mounting is to the transom mounting bracket components such as the tilt tube or other components that rotate with the motor about a horizontal axis, depending upon the particular motor. As illustrated in FIGS. 1-7, a shaft such as shaft 126 may optionally be provided to pass through the tilt tube, or may be provided as a part of the motor mounting. In either case, the tilt tube will in most cases already be secured to the transom, and so will not pivot about a vertical axis. Instead, the tilt tube is designed to rotate about a horizontal axis that extends transverse to the longitudinal axis of the boat, perpendicular to the typical forward travel of the boat. Shaft 126 may be a single unitary shaft, or may be fabricated from several pieces joined together. Further, spacers may be provided to accommodate varying lengths of tilt tubes. A pair of mounting brackets 125 are configured to couple to opposed ends of shaft 126, or to an equivalent mounting adjacent the ends of the motor tilt tube. It is important to note here that mounting brackets 125 will not be fixed to any part of the motor that will pivot as the motor is turned towards port or starboard, which is defined by rotation about a vertical axis, since it is a force about this axis that tiller assist 100 is designed to impart. Instead, tiller assist 100 will preferably be affixed to the motor such that tiller assist 100 will pivot about a horizontal axis as the motor trim is changed, and will follow the motor about a horizontal axis as the motor is tilted forward towards the bow to lift the prop fully out of the water. While a pair of mounting brackets 125 are illustrated, these may be formed as a single unitary structure, having appropriate coupling to shaft 126. Further, the particular manner of coupling shaft 126 and mounting brackets 125 is not critical to the present invention, and may include nuts, screws, or other fasteners.

Movement of the motor about a vertical axis, or in other words, shifting the prop to a more port or starboard location that would steer the boat in a more port or starboard direction, respectively, may be controlled or inhibited by coupling hole 171 with a suitable fastener directly to the steering coupling mounting, on those motors where such a mounting is provided. These steering coupling mountings are typically provided to allow two separate outboard motors to be coupled or linked together to maintain common orientation, or to allow the affixing of hydraulic steering systems, both of which are described and illustrated in the prior art incorporated by reference herein above.

Figure 2:
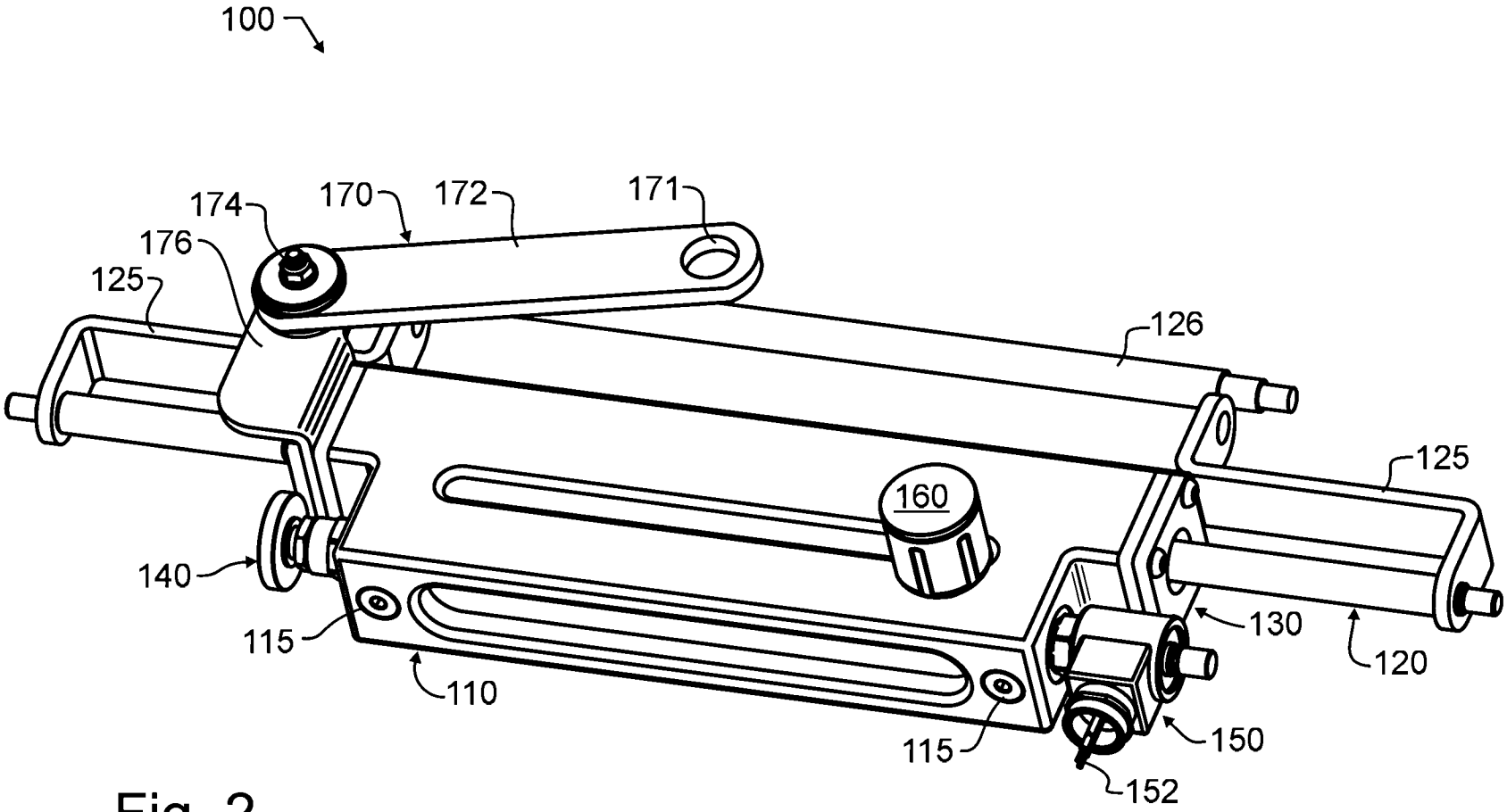
FIG. 2 illustrates the preferred embodiment tiller assist of FIG. 1 from a front and top projected view.
Figure 3:
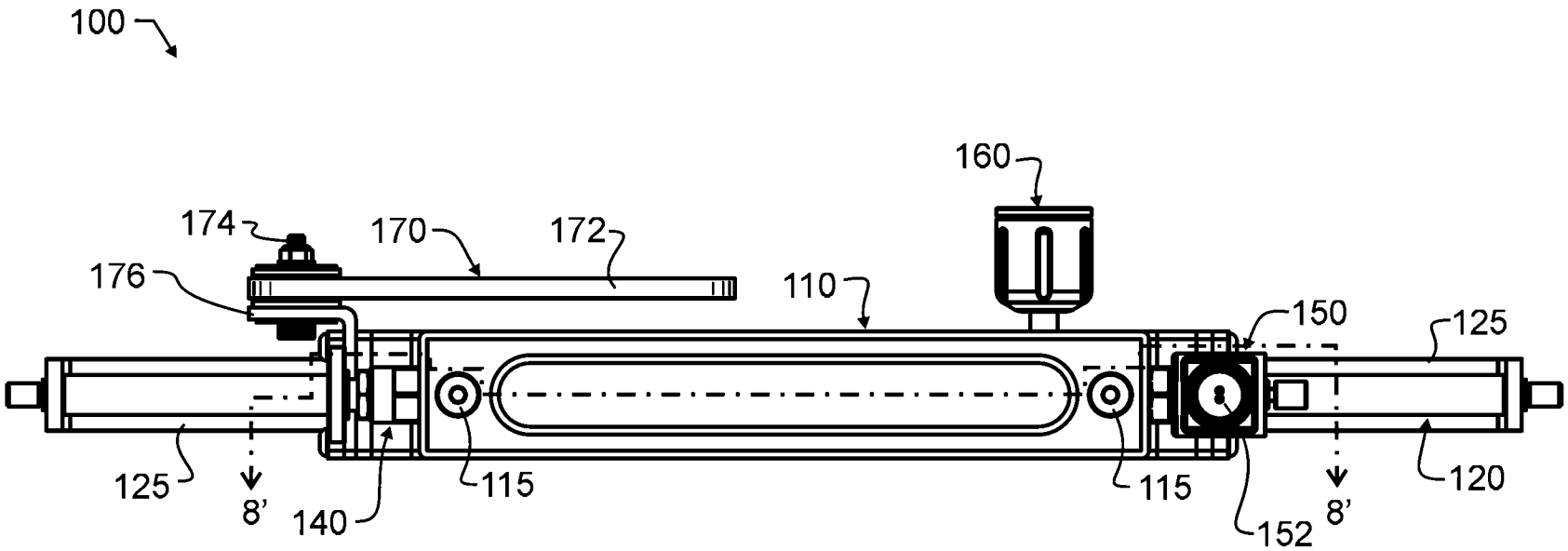
FIG. 3 illustrates the preferred embodiment tiller assist of FIG. 1 from a front view.
Figure 4:
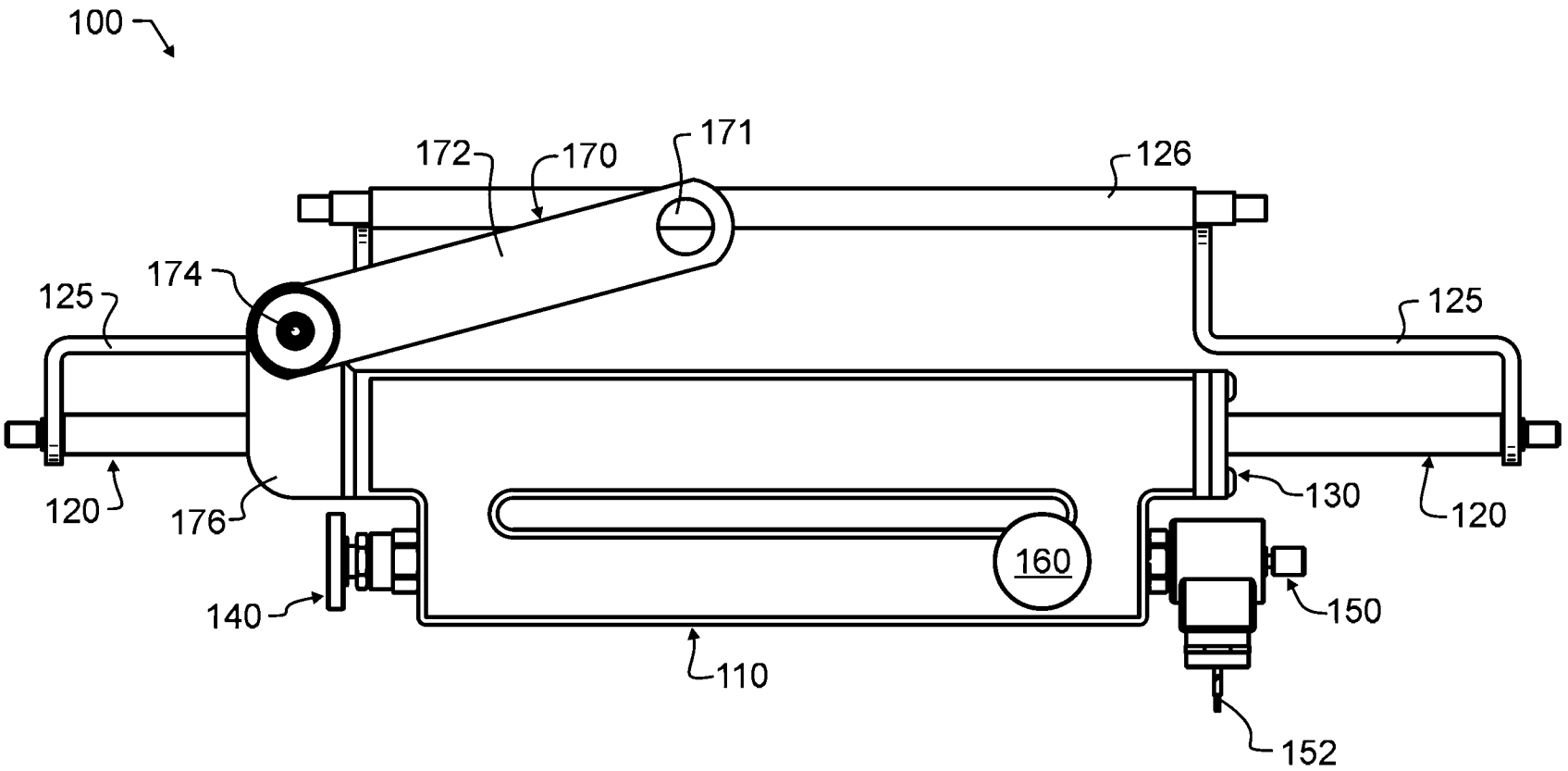
FIG. 4 illustrates the preferred embodiment tiller assist of FIG. 1 from a top view.
Figure 5:
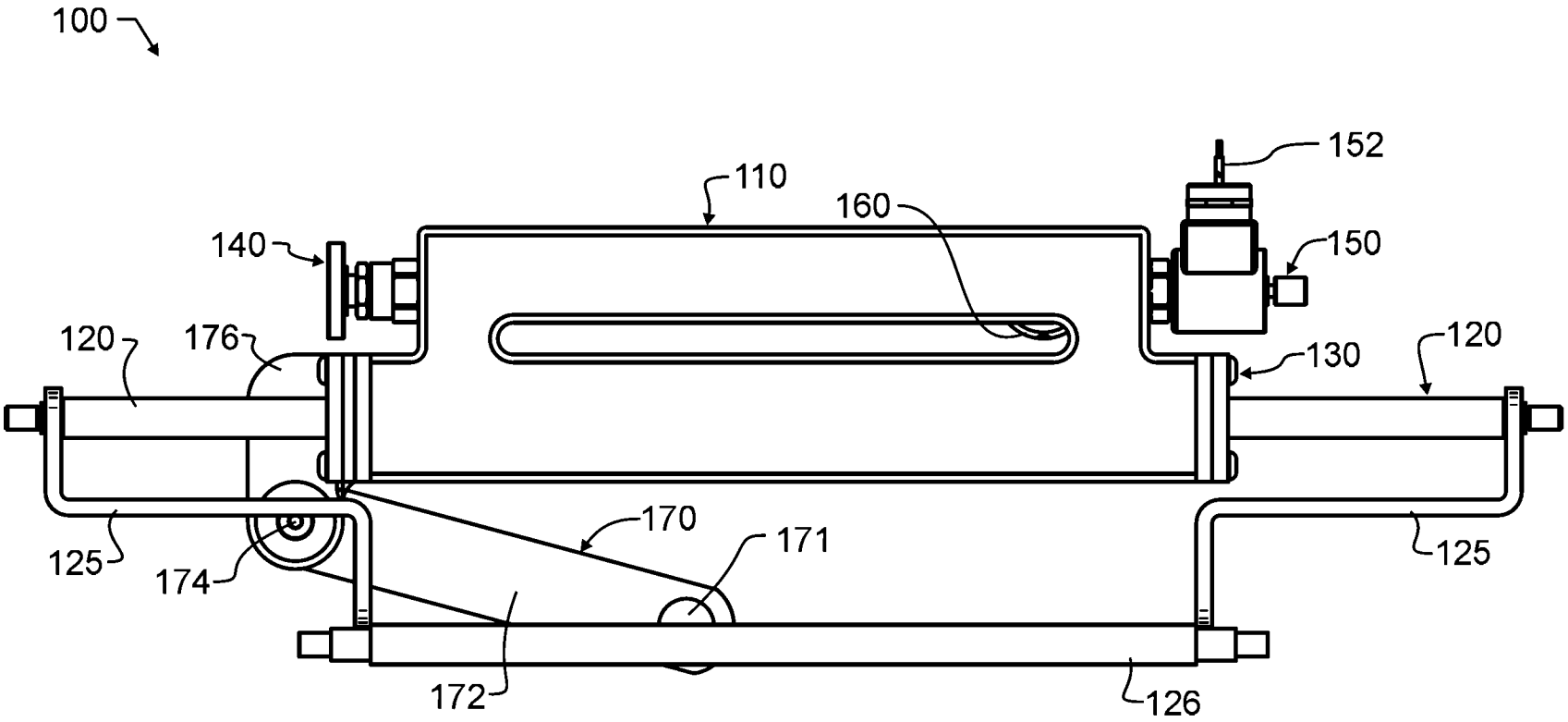
FIG. 5 illustrates the preferred embodiment tiller assist of FIG. 1 from a bottom view.
Figure 6:
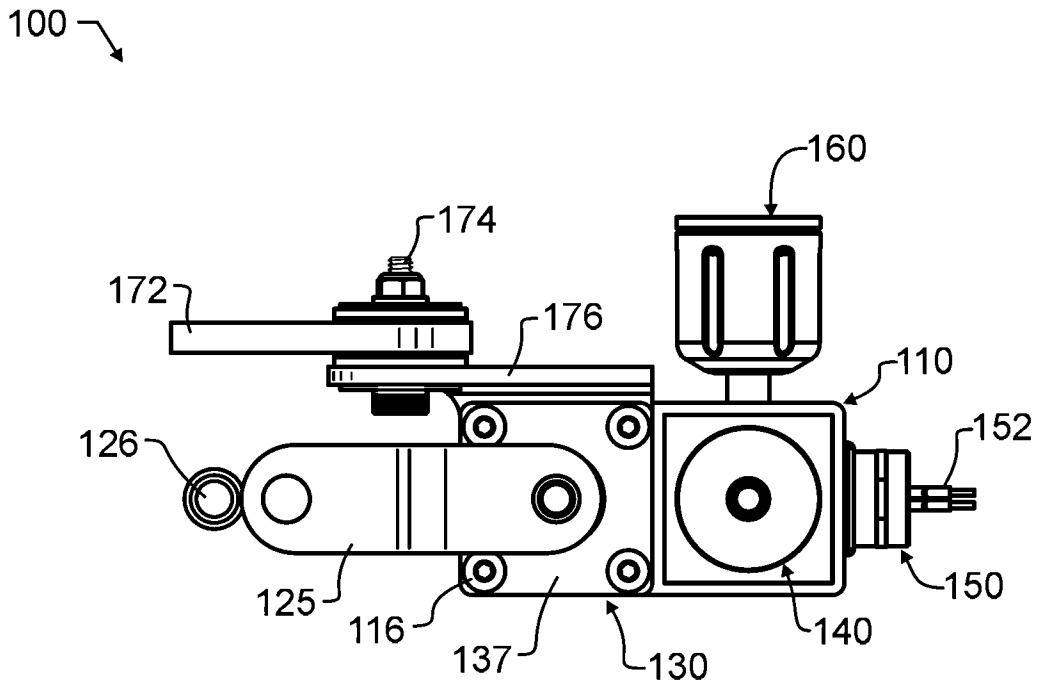
FIG. 6 illustrates the preferred embodiment tiller assist of FIG. 1 from a left side view.
Figure 7:
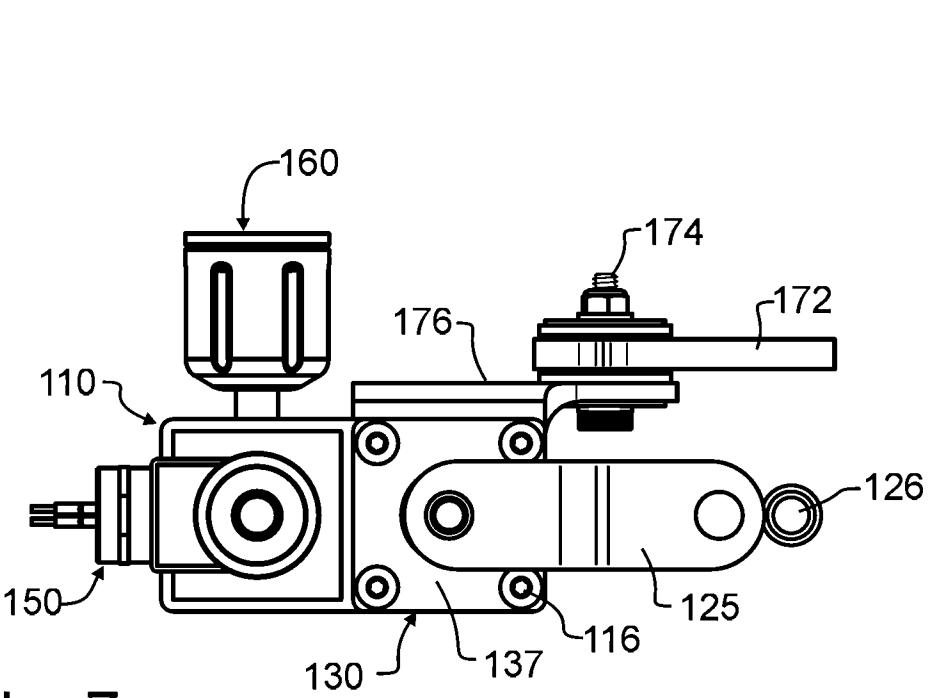
FIG. 7 illustrates the preferred embodiment tiller assist of FIG. 1 from a right side view.

As visible for example in FIG. 2, coupling hole 171 is formed in steering arm 172, which is one part of steering linkage 170. As will be understood, coupling hole 171 may be sized to fit a particular motor, and may further be provided with optional bushings or bearing structures as may be desired. Steering arm 172 is free to pivot about pintle 174, which is in turn coupled to a bracket 176 that is rigidly affixed to cylinder carriage 110. Since steering linkage 170 is coupled between cylinder carriage 110 and a steering coupling mounting on the boat motor, movement of either the boat motor or the cylinder carriage 110 will require movement of the other.

In a least desirable and sometimes unacceptable arrangement, mounting bracket 125 might be fastened to the transom. The reason this mounting is considered less desirable is because, as the motor trim is changed, the orientation of steering arm 172 must change relative to cylinder carriage 110. In the preferred embodiment tiller assist 100 as illustrated, there is no linkage provided to accommodate such angular change due to trim adjustment. Consequently, fashioning a suitable linkage is more complex and expensive.

In preferred embodiment tiller assist 100, cylinder carriage 110 moves relative to a boat transom, and rod/piston assembly 120 is anchored to the tilt tube, which is in turn fixed to the transom. As a result, steering linkage 170 is coupled to and moves with cylinder carriage 110. However, it should be apparent that this arrangement may be reversed, so that in an alternative embodiment rod/piston assembly 120 is instead configured to move relative to a boat transom, and in this alternative embodiment then is coupled directly to steering linkage 170. In this same alternative embodiment, cylinder carriage 110 is anchored to the tilt tube.

Figure 8:
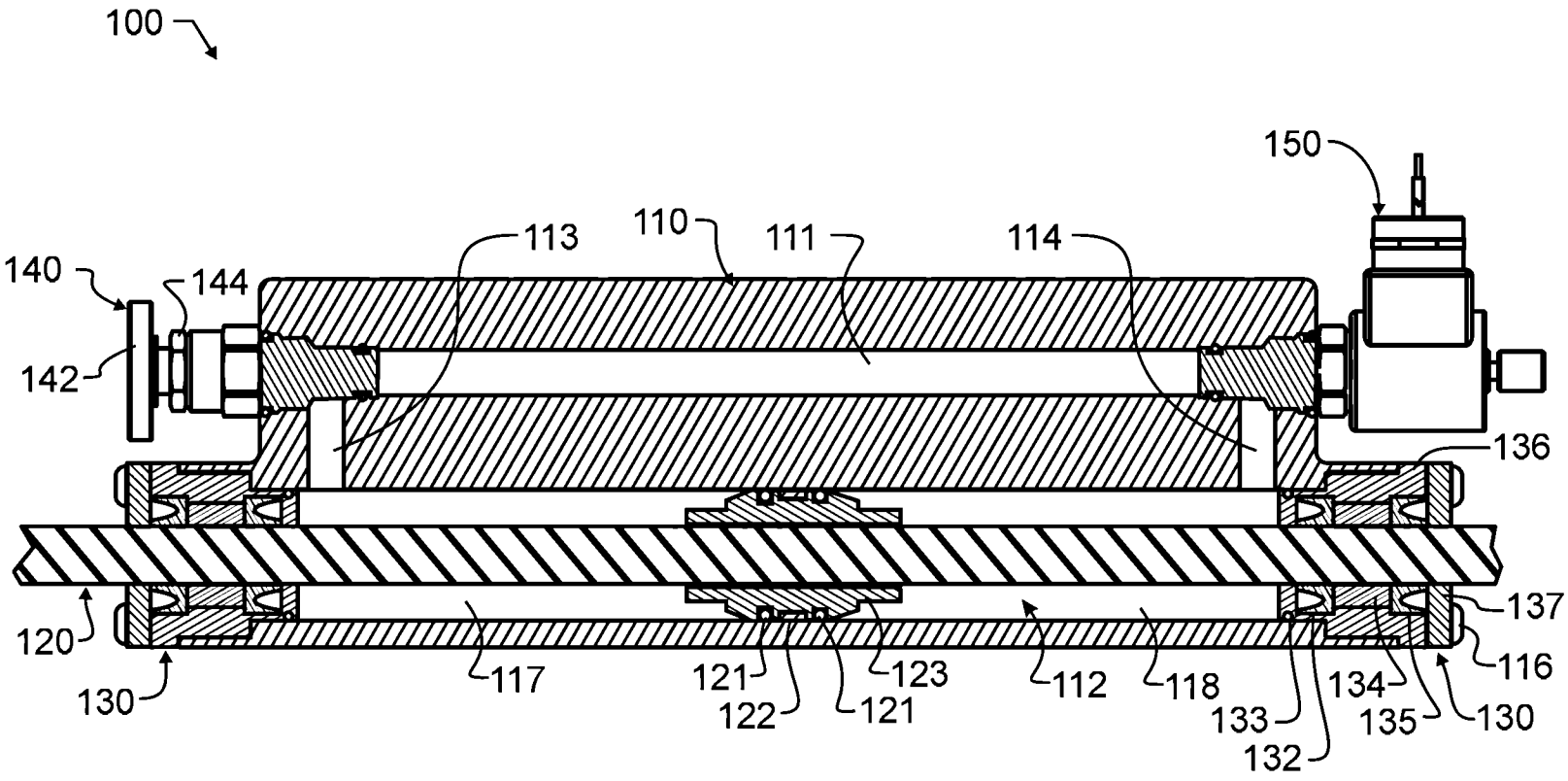
FIG. 8 illustrates the preferred embodiment tiller assist of FIG. 1 from a horizontal plane section view taken along section line 8' of FIG. 3.

As noted, cylinder carriage 110 is configured to travel in a reciprocating manner along rod/piston assembly 120. Referring to FIG. 8, a pair of cylinder head assemblies 130 provide working seals that retain a working fluid within cylinder carriage 110 even as cylinder carriage 110 reciprocates. For exemplary purposes only, and not solely limiting the invention thereto, the working fluid might comprise a hydraulic fluid or oil. A plurality of screws or other suitable fasteners 116 are used to affix cylinder head retaining plate 137 to cylinder head 136, and to simultaneously secure with cylinder carriage 110. An O-ring static head seal 133 ensures a leak-free seal between cylinder head 136 and cylinder carriage 110. Cylinder head assembly 130 contains a sleeve bushing 134 that may for exemplary but non-limiting purposes be comprised by sintered bronze. A rod seal 132 and snap-in wiper seal 135 complete the fluid seal.

The working fluid is constrained to a fluid flow path comprising central bore 112, a primary bypass passage 111 that is generally parallel to and displaced from central bore 112, and two transverse passages 113 and 114 that couple central bore 112 to primary bypass passage 111 on distal ends thereof. This is preferred, since the working fluid is stored within and constrained entirely within cylinder carriage 110. However, in alternative embodiments contemplated herein, any suitable fluid pathways may be used. Accordingly, in some alternative embodiments, caps 115 may be removed and working fluid may then be coupled to a closed path that is external to cylinder carriage 110.

Cylinder piston 123 is rigidly affixed to rod/piston assembly 120, and divides central bore 112 into two chambers 117, 118. Cylinder piston 123 is provided with a pair of piston seals 121, which may for exemplary purposes comprise an energized u-cup seal, and a piston guide ring 122 in the center thereof. As a result, the working fluid cannot pass through cylinder piston 123 to flow between chambers 117, 118.

While cylinder piston 123 is illustrated in preferred embodiment tiller assist 100 as a single piston having two faces, in an alternative embodiment cylinder piston 123 may alternatively comprise two faces separated from each other by some distance, and coupled to each other through a rod or other coupler. In either embodiment, cylinder piston 123 prevents working fluid from passing through cylinder piston 123 to flow between chambers 117, 118.

As cylinder carriage 110 moves relative to rod/piston assembly 120, central bore 112 will shift relative to a cylinder piston 123. This relative movement will decrease the volume of space within a first one of chambers 117, 118, while simultaneously increasing the volume of space within the other of chambers 117, 118 by the same amount. Since the working fluid cannot pass through cylinder piston 123 to flow between chambers 117, 118, this relative movement between cylinder carriage 110 and rod/piston assembly 120 acts as a pump, forcing working fluid displaced from the decreasing volume chamber through transverse passages 113 and 114 and primary bypass passage 111 to the increasing volume chamber. As may be apparent then, as cylinder carriage 110 reciprocates, the working fluid will be pumped back and forth between chambers 117 and 118, alternating flow between a clockwise and counterclockwise direction in the flow path of FIG. 8. With each direction of travel, the working fluid will pass through transverse passages 113 and 114 and primary bypass passage 111.

Hydraulic needle valve 140 and solenoid valve 150 are provided within the closed loop fluid flow path, and are configured to selectively control the flow of working hydraulic fluid through the closed loop fluid flow path. If hydraulic needle valve 140 and solenoid valve 150 are both fully open, then cylinder carriage 110 is free to reciprocate along rod/piston assembly 120 with only minimal resistance thereto. The working fluid simply circulates from a first one of chambers 117, 118 past both of hydraulic needle valve 140 and solenoid valve 150 and back to a second one of chambers 117, 118 on the opposite side of cylinder piston 123. Consequently, when hydraulic needle valve 140 and solenoid valve 150 are both in an open state, the flow path defines a continuous closed path from a first side of cylinder piston 123 to a second side of the cylinder piston. In this open state, the tiller may operate essentially as it would without the present invention, free to move or be moved at will.

However, if either one or both of hydraulic needle valve 140 and solenoid valve 150 are fully closed to block the flow of working fluid, and since the working fluid is essentially incompressible, then there is no way to change the volume of either of chambers 117, 118. For example, presume that cylinder carriage 110 is being driven in a direction to decrease the volume of chamber 117, which would be to the left as illustrated in FIG. 8. If hydraulic needle valve 140 is closed, then working fluid within chamber 117 and transverse passage 113 are trapped, with no place to evacuate to. This means that the working fluid within chamber 117 and transverse passage 113 will prevent any movement of cylinder carriage 110 that would decrease the volume of chamber 117. Instead, the working fluid within chamber 117 will simply increase to a pressure sufficient to halt such movement. With an incompressible working fluid, even the most minute movement will generate an enormous pressure rise, meaning cylinder carriage 110 simply cannot move relative to rod/piston assembly 120. Note that the same is true for any motion in the other direction, since working fluid within chamber 118 is also prevented from escaping due to the same closed hydraulic needle valve 140. In other words, by closing either one of hydraulic needle valve 140 and solenoid valve 150, cylinder carriage 110 will be locked in place relative to rod/piston assembly 120, and cannot reciprocate. This will be referred to herein as the second closed state.

In this second closed state, the flow path is interrupted between the two chambers 117, 118, and occurs when at least one of the hydraulic needle valve 140 and solenoid valve 150 are closed. In this second closed state, the tiller is locked in position and cannot rotate to steer towards port or starboard. This can only occur when the flow path is completely interrupted between the two chambers 117, 118. This second closed state is desirable when a tillerman wishes to traverse in either a straight line, or through a longer and consistent curve. By closing one or both of the valves 140, 150, the tiller is locked in position and the boat motor will be maintained in the same orientation, regardless of reasonable external forces.

Preferably, solenoid valve 150 in the preferred embodiment is a 2-way, normally open, spool type valve having an electrical connector 152 coupling to a suitable switch and power source. By making solenoid valve 150 a normally open valve, any disruption of electrical power will ensure that the valve remains open and the boat motor steerable. However, a simple electrical switch can be used by a tillerman to lock the steering, allowing a tillerman to easily control the locking or unlocking of the position of the boat motor.

In a third partially obstructed state, the flow path is restricted between the two chambers 117, 118. This occurs when at least one of the hydraulic needle valve 140 and solenoid valve 150 are partially closed, restricting the flow of fluid through the flow path. In this third partially obstructed state, controlled resistance to movement of the tiller is created. Since either one or both of hydraulic needle valve 140 and solenoid valve 150 are partially closed to restrict the flow of working fluid, then cylinder piston 123 can only move as quickly as the necessary volume of working fluid can be transferred past the obstructing valve (s). This controlled resistance can be extremely beneficial in choppy waters or where only minimal steering adjustments are required, since a sudden but short-lived force that would otherwise cause the motor to veer left or right will be prevented by the inability to move any consequential volume of working fluid between the two chambers 117, 118 in a short time period. This will drastically reduce the tendency of the tiller to push against the tillerman, and will thereby reduce the fatigue of the tillerman over time. This third partially obstructed state can also then be particularly useful where a tillerman wishes to hold a light grip on the steering arm, and not be affected by vibrations and disruptions that would normally be transmitted through to the steering arm. These will instead be effectively damped out by the restriction of flow through hydraulic needle valve 140.

Hydraulic needle valve 140 may be used to mechanically block fluid flow, and also may then be used to lock the steering. However, hydraulic needle valve 140 is also preferably infinitely adjustable, meaning the volume of fluid passing through hydraulic needle valve 140 may be controlled by adjustment of the needle valve. This means that hydraulic needle valve 140 may also be used to act as a damper, preventing rapid motion of the boat motor relative to the boat hull. Since hydraulic needle valve 140 is adjustable, each tillerman may select a preferred amount of damping to suit their needs. Knob 142 of needle valve 140 may be manually turned to set to a particular flow rate, and then this flow rate locked using lock nut 144 numbered in FIG. 8. While a manually adjusted knob 142 and lock nut 144 are preferred, owing to their simplicity, reliability, lack of need for additional tools, and intuitive use, in alternative embodiments other techniques of adjustment are also contemplated. These may be infinitely adjustable, or may alternatively be adjusted in a step-wise fashion. For exemplary and non-limiting purposes, various controls such as electrical stepper motors, stepped valves, and other known techniques of providing variable flow restriction will be understood to be incorporated in alternative embodiments.

While two different valves 140, 150 are preferred for the ease of electrically locking preferred embodiment tiller assist 100 in position and the ease of presetting a particular amount of damping using needle valve 140, only one of the solenoid valve 150 and hydraulic needle valve 140 are required to achieve similar function, if not as conveniently. In alternative embodiments it is contemplated to only provide one or the other, but to enable the single provided valve to both block and selectively restrict fluid flow. In addition, while particular apparatus are illustrated and described in accord with the requirement to illustrate the preferred embodiments, it will also be recognized that each of these solenoid valve 150 and hydraulic needle valve 140 are flow restrictors, and that other known valves and other flow restrictors will be considered to be alternative embodiments incorporated herein that are too numerous to specifically describe. In addition, while a hydraulic fluid is preferred for use in the present invention, other fluids may be used. Consequently, a variety of fluids may be introduced into the fluid flow path to obtain a desired behavior of preferred embodiment tiller assist 100. While preferred embodiment tiller assist 100 uses a single cylinder carriage 110 to contain hydraulic fluid, the invention is also not limited solely thereto.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 9:
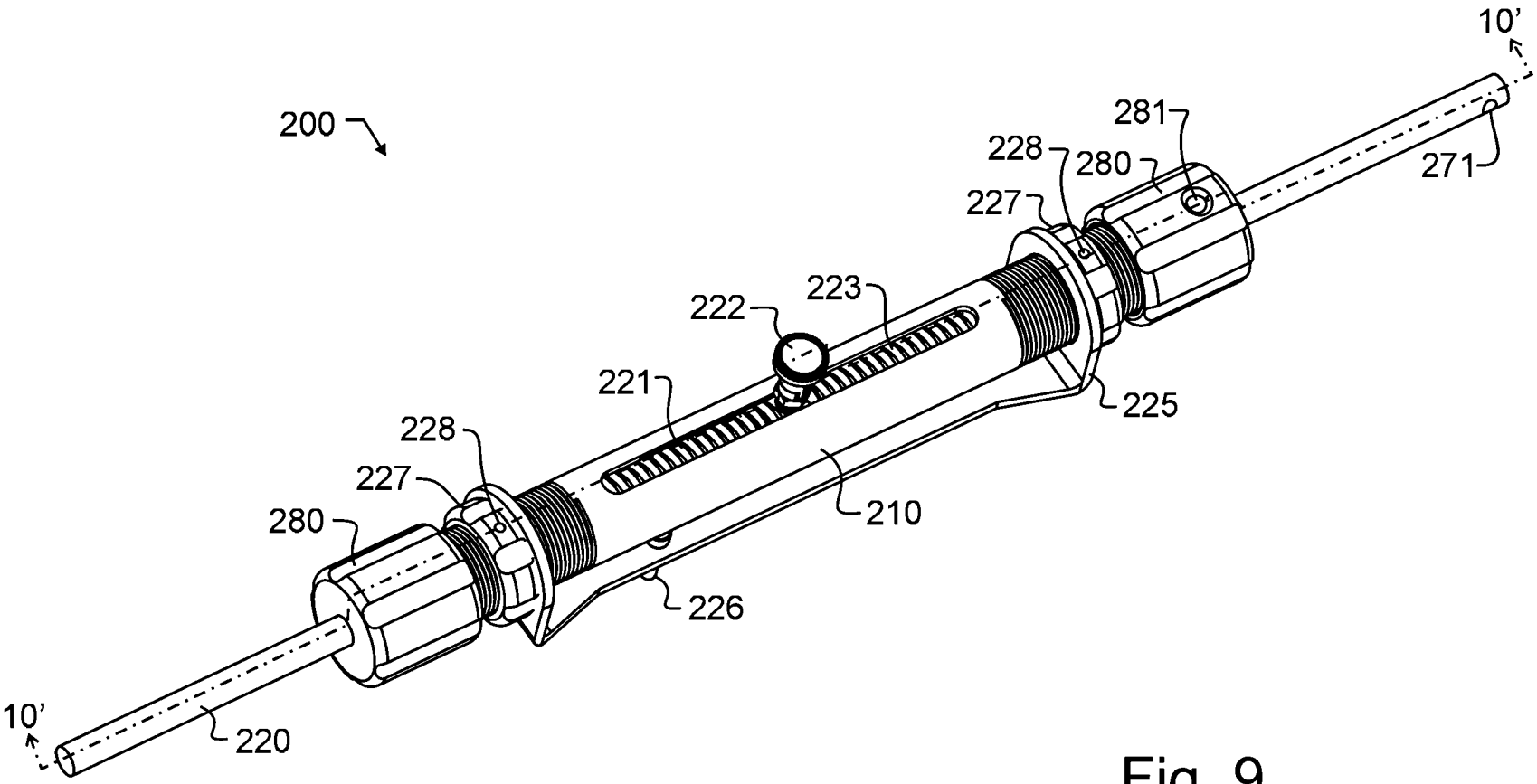
FIG. 9 illustrates a first alternative embodiment tiller assist designed in accord with the teachings of the present invention from projected view.
Figure 10:
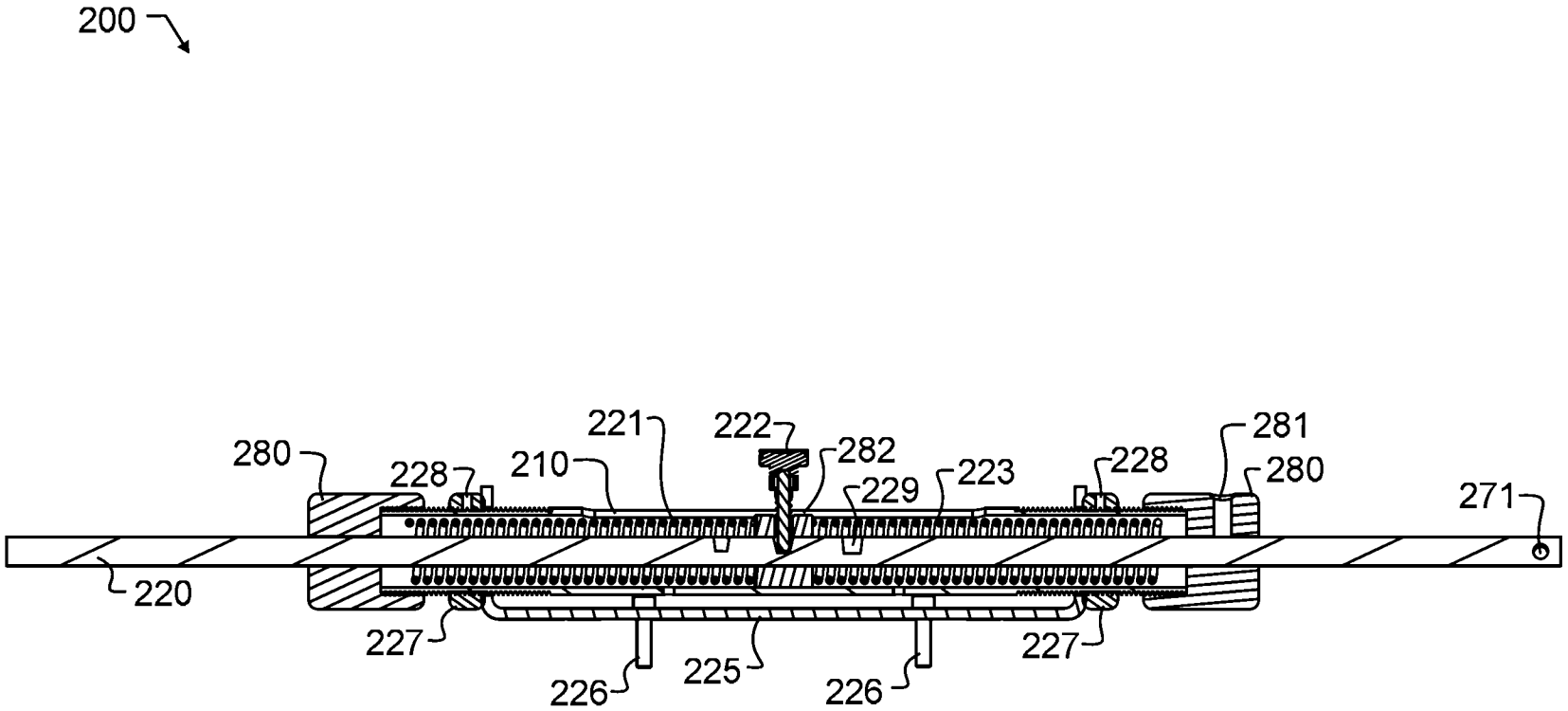
FIG. 10 illustrates the first alternative embodiment tiller assist of FIG. 9 from a vertical central plane sectional view taken along section line 10' of FIG. 9.

In a first alternative embodiment of the invention illustrated in FIGS. 9-10, a tiller assist 200 is comprised of a central coupling rod 220 having one or more recesses 229 and a coupling 271 operative to link to a tiller arm, a co-axial tube 210, a mounting bracket 225 and suitable fasteners 226, a nut 227 adjacent each distal end of co-axial tube 210 securing co-axial tube 210 to mounting bracket 225, a pair of springs 221, 223 co-axial with and surrounding coupling rod 220 and interior of co-axial tube 210, a pair of adjustable end caps 280 closing the gap between the ends of co-axial tube 210 and coupling rod 220 while also acting as stops for springs 221, 223, a slide 282 located between the pair of springs 221, 223, and a set pin 222 operatively passing through slide 282 and into one or more of the recesses 229 in coupling rod 220 but also operatively removable from the recesses 229.

The first alternative embodiment tiller assist 200 may be mounted to a boat or motor in a number of different ways, depending upon the features available in the motor and tiller. A preferred mounting is directly to the steering coupling mountings, on those motors where such mountings are provided. These steering coupling mountings are typically provided to allow two separate outboard motors to be coupled or linked together to maintain common orientation. In this case, fasteners 226 may typically be bolts that are screwed into existing threaded holes, making the attachment quite simple.

When a motor is not provided with steering coupling mountings, first alternative embodiment tiller assist 200 may alternatively be mounted to the transom mounting bracket components such as the tilt tube or other components that rotate with the motor about a horizontal axis, once again depending upon the particular motor. In this case, additional hardware may be provided to couple with the tilt tube or other like moving components. It is important to note here that the mounting bracket will not be fixed to any part of the motor that will pivot as the motor is turned towards port or starboard, which is defined by rotation about a vertical axis, since it is a force about this axis that the tiller assist is designed to impart. Instead, first alternative embodiment tiller assist 200 will preferably be affixed to the motor such that first alternative embodiment tiller assist 200 will pivot about a horizontal axis as the motor trim is changed, and will follow the motor about a horizontal axis as the motor is tilted forward towards the bow to lift the prop fully out of the water.

In a least desirable and sometimes unacceptable arrangement, mounting bracket 225 might be fastened to the transom. The reason this mounting is considered less desirable is because, as the motor trim is changed, the distance and relative angle between the tiller arm and coupling 271 at the end of coupling rod 220 will change. Consequently, fashioning a suitable linkage is more complex and expensive, and changing the trim angle may change the amount of force that first alternative embodiment tiller assist 200 generates.

Once fasteners 226 are used to anchor mounting bracket 225 to a suitable apparatus, the co-axial tube 210, springs 221, 223, and slide 282 will preferably be inserted through the distal opening in bracket 225, and the two nuts 227 will be threaded onto co-axial tube 210. The use of threading at the distal ends of co-axial tube 210 and nuts 227 to fasten to mounting bracket 225 permits the tube 210 to be adjusted towards one end or the other of mounting bracket 225, which can help during later adjustment of first alternative embodiment tiller assist 200.

Once the nuts 227 are fastened, a pair of distal end caps 280 are threaded onto the ends of co-axial tube 210. These end caps 280 perform several useful functions simultaneously. A first function is to act as an end stop for one of the spring pair 221, 223. The location of this end stop is determined by how far onto co-axial tube 210 the end cap 280 is threaded, making each end stop adjustable. A second function is to act as a linear bearing for coupling rod 220. As coupling rod 220 slides within co-axial tube 210, it requires something to keep it centered and not droop in a direction of gravity, inertia, or other applied force. These end caps 280, if so designed, may provide a linear bearing surface which keeps coupling rod 220 centered and able to move along its longitudinal axis in either direction with only a minimum of force required. As a result, it is preferable that end caps 280 be fabricated from a suitable bearing material. For exemplary purposes, this may be a durable and lubricious plastic, of which there are many to choose from including but not limited to such materials as nylon, polyaramids, polyamides, polyacetals, polyethylene, High Density Polyethylene (HDPE), Ultra-High Molecular Weight (UHMW) polyethylene, and polypropylene. Preferably, however, if there is any fill added to the plastic, such fill will not be abrasive. As a result, glass fibers will preferably not be added, though fibers such as Kevlar™ and graphite may be acceptable or even beneficial.

Coupling rod 220 may be inserted into co-axial tube 210 either prior or subsequent to the time of fastening opposed nuts 227 and end caps 280. Regardless of when, at this point in the assembly coupling rod 220 will preferably be in place.

Set pin 222, if not previously inserted, will now preferably be installed, passing at least into slide 282, and optionally through slide 282 and into one or more recesses 229 formed in coupling rod 220. If recesses 229 are provided, which is preferred, then set pin 222 will preferably be spring loaded to push into the recesses, and otherwise slide along the surface of coupling rod 220 without generating any consequential friction therewith. In this case, there will be an exterior housing that may screw, thread, or otherwise affix to slide 282, and an interior pin that is spring or otherwise biased towards coupling rod 220.

When set pin 222 is either removed or retracted from engaging with recesses 229 in coupling rod 220, coupling rod 220 is free to slide along the longitudinal axis of coupling rod 220, either bringing coupling 271 closer to or farther from the closest end cap 280. Consequently, in this position, first alternative embodiment tiller assist 200 is inoperative, but also not interfering with the normal operation of the tiller steering.

In alternative embodiments contemplated herein, set pin 222 may comprise one or more alternative constructions. A first construction is an electrically controlled solenoid that is affixed to slide 282, and which might for exemplary purposes, include a spring tending to drive the solenoid armature into coupling rod 220. However, when energized, the magnetic field will overcome the spring force and will withdraw the solenoid armature from a recess 229 in coupling rod 220. This electromagnetic control allows an operator to more remotely engage or disengage set pin 222, using an electrical switch.

Another alternative embodiment set pin 222 is controlled through a Bowden cable using a bicycle hand brake or the like to actuate movement of the cable. The cable preferably terminates at the pin, and a spring biases the pin into the recess. When the hand brake is squeezed, the cable will overcome the spring force and the pin will retract from a recess 229. Once again, this allows remote actuation of set pin 222. As will be apparent from the foregoing, there are a variety of methods and techniques that are known equivalents to the aforementioned solenoid and Bowden cable controls, each of which will be considered to be incorporated herein. Furthermore, while the foregoing descriptions describe a spring as being biased to drive a pin or solenoid armature into recesses 229 in coupling rod 220, the spring may alternatively be biased to keep the pin out, and the electrical or mechanical control instead used to drive the pin into a recess 229.

At this point in the assembly process, first alternative embodiment tiller assist 200 should resemble FIGS. 9-10, at least having each of the necessary components. Some additional optional features and components may also be provided. As will be understood, with any vessel that will be provided with a tiller handle, there is a strong likelihood that there will also at least occasionally be a great deal of vibration. This vibration can come from many sources, including the engine and the impacts between the boat hull and the water. This vibration might be prone to shake loose one or more of the nuts and end caps, and in so doing could disrupt the proper operation of the tiller assist. While many other techniques could be used in keeping with the spirit of the invention, in the preferred embodiment a threaded hole 228 is provided in each of the nuts 227. Into this threaded hole 228, a set screw may be inserted and turned to apply force to the threads in the co-axial tube 210. The additional friction or interference created there between will further ensure that the nuts 227 do not shake loose from vibration. Other contemplated techniques include the use of self-locking threads, such as are found on the Nylock™ nuts and other comparable nuts sold commercially.

Another threaded hole 281 for a locking set screw may be provided through one or both end caps 280. In this case, if a set screw is inserted and tightened down against coupling rod 220, coupling rod 220 will no longer be able to slide along the longitudinal axis. As a result, coupling rod 220 will be fixed in place. This is similar to the second closed state of preferred embodiment tiller assist 100 described herein above.

Once first alternative embodiment tiller assist 200 is mounted and assembled, it will need to be coupled to the appropriate steering components on the motor. This may be through steering links, steering rods, or even directly to tiller handle, depending upon the particular motor. Once again, depending upon the motor and available features, this may require additional links, brackets and other fasteners, as will be apparent to those reasonably skilled in the art. To facilitate such coupling, first alternative embodiment tiller assist 200 is provided with at least one coupling 271 at the end of coupling rod 220. This may simply be a hole through coupling rod 220, through which a pin, bolt, or other fastener may pass, or may comprise a threaded hole or any other suitable structure or apparatus. Further, while only one coupling 271 is illustrated, there is no limitation thereto, and instead a plurality of alternative couplings may be provided. Where a simple pin such as a cotter pin or the like is used, the cotter pin may be removed to easily disconnect first alternative embodiment tiller assist 200 from the tiller arm, and thereby revert to the tillerman fully manually operating the tiller arm. This can act as a fail safe if something breaks, and this also helps to simplify installation and adjustment.

When first alternative embodiment tiller assist 200 is assembled and coupled as described, there are three different and distinct modes of operation. The first, and described herein above, is one where set pin 222 is retracted or removed, and there is not a locking set screw passing through end cap threaded hole 281 and engaged with coupling rod 220. When so configured, coupling rod 220 is free to slide along its longitudinal axis, meaning that it will move with and impart no forces upon the engine. Consequently, a tillerman may control the motor as if the tiller assist was not there.

As may be apparent, this first alternative embodiment tiller assist of FIGS. 9-10 is a mechanical alternative to the fluid preferred embodiment tiller assist 100. Damping and locking may also optionally be provided.

In a second configuration, and also briefly described herein above, a locking set screw is passed through end cap threaded hole 281 and engaged with coupling rod 220. In this case, coupling rod 220 is held in a fixed position. Since coupling 271 is further affixed to the motor steering or tiller arm, this means that the tiller arm will also not be pivotal in the port or starboard directions. If the set screw is a thumb screw or the like, this allows the operator to point the engine in a particular direction, and lock it in that direction. This can be quite useful when, for exemplary and non-limiting purposes, there is a large body of water to be traversed and the tillerman simply wants the boat to travel straight across the water. By locking first alternative embodiment tiller assist 200 in place, the motor will stay directed regardless of any torque or other reasonable and ordinary forces that may be generated. Another use arises during transport of the boat, when it may be desirable to lock the motor in place. Finally, if the set screw is only partially tightened, then controlled friction may be generated that must be overcome before there is any change in steering. This can be useful to take out or eliminate any steering affect from the small bumps and pushes that occur as a boat is traveling through the water, while still allowing the tillerman to purposefully redirect the motor.

In a third configuration, any set screw passing through the end cap is disengaged from the coupling rod, but set pin 222 is allowed to project into one of the one or more recesses 229 formed into coupling rod 220. In this configuration, as the tiller is rotated from port to starboard and back, coupling rod 220 will move along its longitudinal axis, shifting coupling 271 closer to and farther from adjacent end cap 280. Depending upon the placement of recesses 229 in coupling rod 220 and the relative size of springs 221, 223, slide 282, co-axial tube 210, and end cap 280, at some point of travel the slide 282 will begin to compress one of the springs 221, 223 between slide 282 and an end cap 280. As may be quite apparent, this is factory adjustable by controlling the relative sizes and positions as just aforementioned. The operator will further be able to control when the spring 221, 223 begins to compress by choosing which recess 229 to drop set pin 222 into, and how tightly to screw the end caps 280 onto co-axial tube 210. As may also be apparent, once slide 282 begins to compress the associated spring 221 or 223 against the associated end cap 280, further movement of coupling rod 220 will further compress the spring, which results in a continually increasing spring force.

In one embodiment, and as illustrated, two relatively equal springs 221, 223 may be used, and set pin 222 may drop into a relatively centrally located position along coupling rod 220. In this position, springs 221, 223 will tend to keep set pin 222 centered, which means, if so positioned relative to the motor, first alternative embodiment tiller assist 200 will act as a centering force, tending to return the tiller to a central position.

In another embodiment, only one spring may be provided, or the springs 221, 223 may be of unequal size, or set pin 222 may be dropped into a different recess 229 such that one spring begins to compress before the other. This is most useful when a tillerman or operator would like to offset, reduce or eliminate the torque forces generated by the interaction of the propellor with the water. In this case, first alternative embodiment tiller assist 200 can be positioned and configured to selectively apply a force in one direction of motor rotation, or in one direction long before such forces are applied in the other.

The length and spring constant of each spring 221, 223 may be custom-selected by the operator to expand the working range of forces, and initiation of application of those forces to the tiller arm or motor. Where desired, a plurality of different springs may be provided, such as to accommodate various horsepower ratings of engines, or to control at what angle of rotation first alternative embodiment tiller assist 200 begins to apply force.

The first alternative embodiment tiller assist 200 has great ability to vary, adjust and control the forces generated to meet the varying needs of a tillerman, helmsman, or operator. Nevertheless, and while outboard motors represent the preferred application for the present invention, the present invention is not solely limited to use with outboard motors, and may be used with other motors where the application will be suitable.

Figure 11:
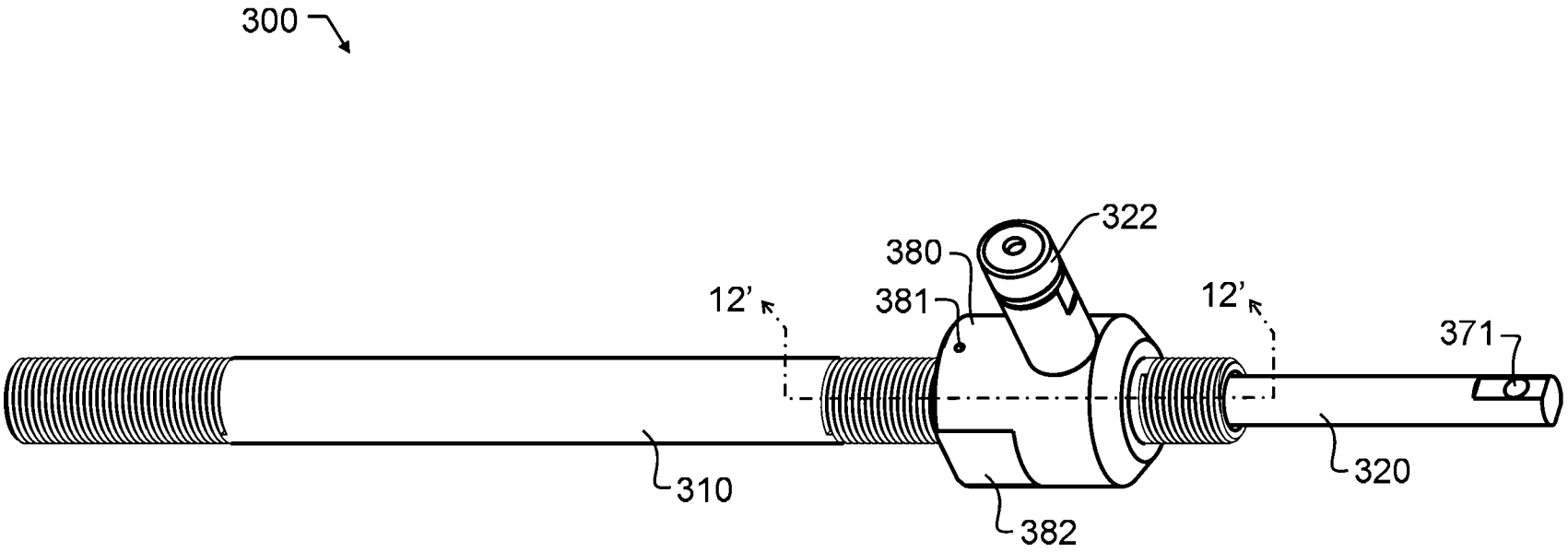
FIG. 11 illustrates a second alternative embodiment tiller assist designed in accord with the teachings of the present invention from projected view.
Figure 12:
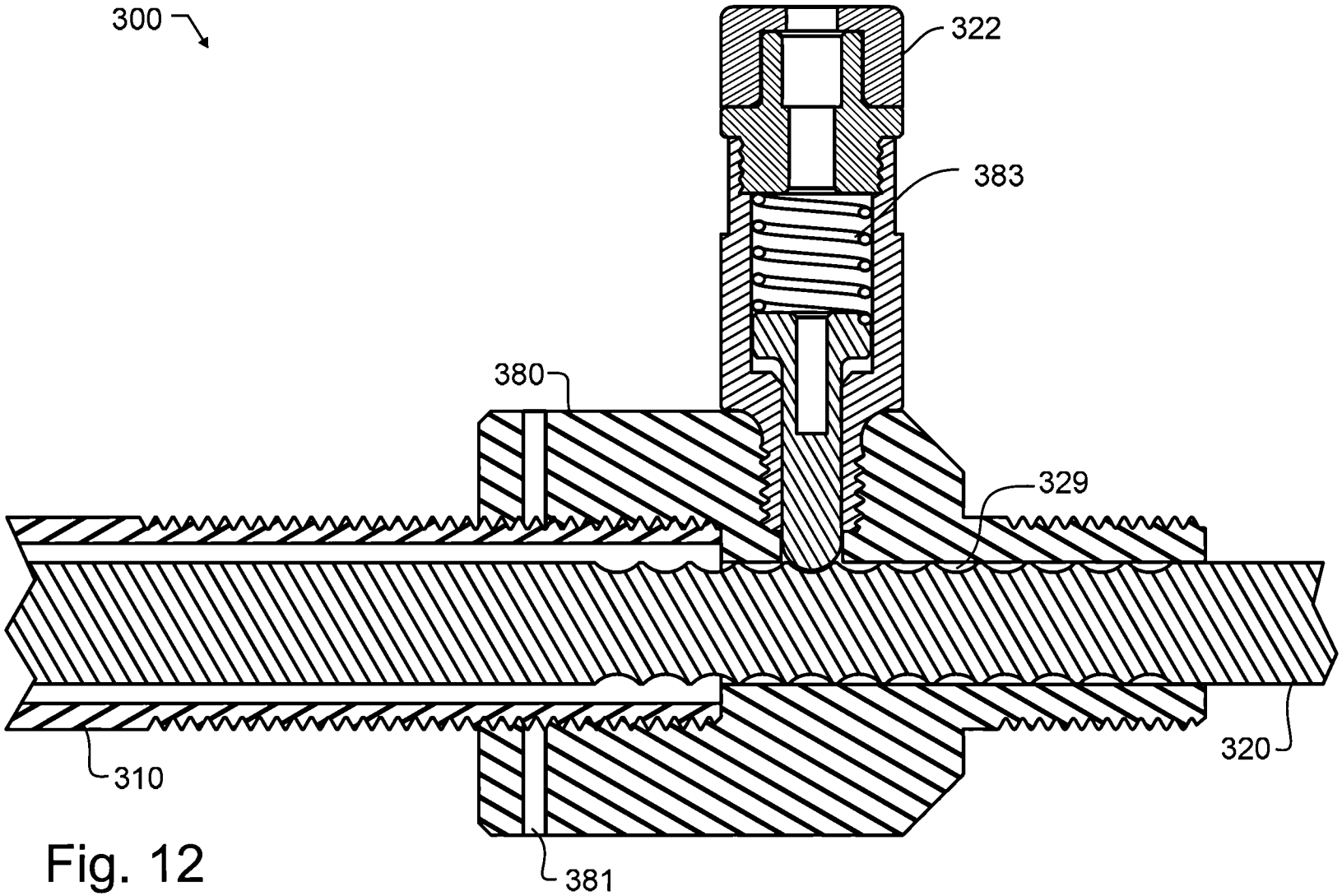
FIG. 12 illustrates the second alternative embodiment tiller assist of FIG. 11 from a vertical central plane sectional view taken along section line 12' of FIG. 11.

FIGS. 11-12 illustrate a second alternative embodiment tiller assist 300. Like components to those of FIGS. 9-10 are labeled on the drawing figures, to permit comparison there between. Notably, the use of a single end cap 380 affixed to co-axial tube 310 and the lack of a spring co-axial with coupling rod 320 eliminates the ability of this second alternative embodiment tiller assist 300 to provide centering assistance. However, the reduced parts count lowers production costs and simplifies the operation of the device. An optional spring 383 is provided within set pin 322 to ensure positive engagement of set pin 322 into recesses 329. An optional wrench flat 382 may be provided to assist with assembly.

Figure 14:
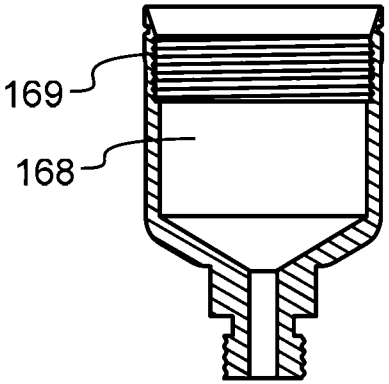
FIGS. 13-15 illustrate a preferred accumulator used in the preferred embodiment tiller assist from front view with cap, vertical plane section without cap, and top view without cap, respectively.
Figure 16:
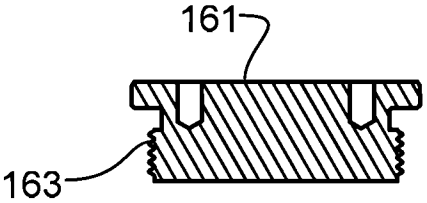
FIG. 16 illustrates the preferred accumulator cap used together with the preferred accumulator of FIG. 13 from vertical plane section view.
Figure 13:
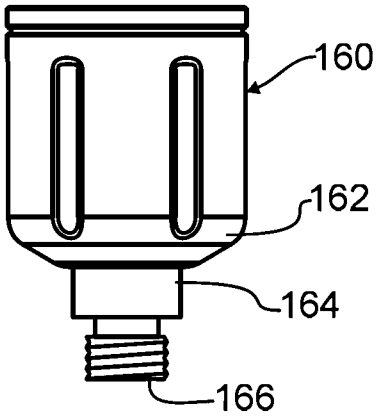
Figure 15:
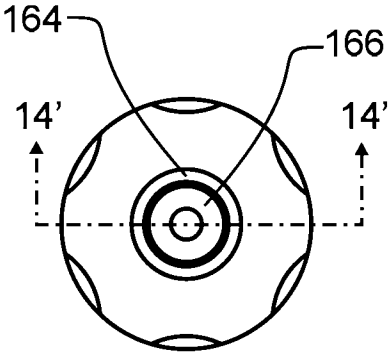

FIGS. 13-15 illustrate an optional accumulator 160 with and without cap 161. A relatively larger body 162 tapers in a funnel-like fashion to a reduced neck 164, and finally terminates with threads 166 that may be used to securely couple into cylinder carriage 110. As shown from the vertical section of FIG. 14, a hollow interior 168 holds excesses working fluid, while threads 169 adjacent a top thereof receive threaded cap 161 illustrated in FIG. 16. Cap 161 will, of course, be provided with a suitable mating fastener, in this case threads 163, though it will be apparent that any suitable method of providing a removable cap is contemplated herein. In one embodiment, accumulator 160 may also act as a fill port to adjust the level of hydraulic fluid within cylinder carriage 110. Accumulator 160 provides a means to limit the maximum pressure within the fluid path. While most hydraulic fluids have only minor expansion and contraction through temperature, in an air free system even a small expansion or contraction can lead to extreme pressure changes that in some rare instances can undesirably lead to a binding of cylinder piston 123 within central bore 112.

Figure 17:
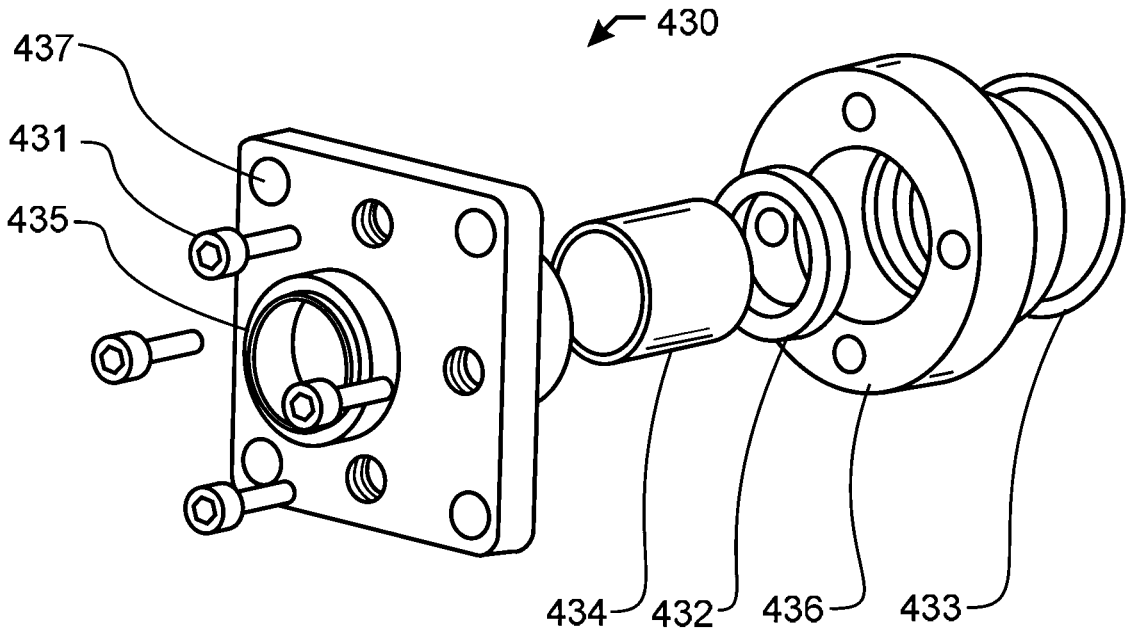
FIG. 17 illustrates a first alternative embodiment cylinder head assembly by exploded view.

FIG. 17 illustrates a first alternative embodiment cylinder head assembly 430 that may be used in the preferred embodiment tiller assist 100 by exploded view. A plurality of screws or other suitable fasteners 431 are used to affix cylinder head retaining plate 437 to cylinder carriage 110. Cylinder head 436 contains a rod seal 432, an O-ring static head seal 433, and a sleeve bearing 434. A double-lip snap-in wiper seal 435 completes the fluid seal.

Figure 18:
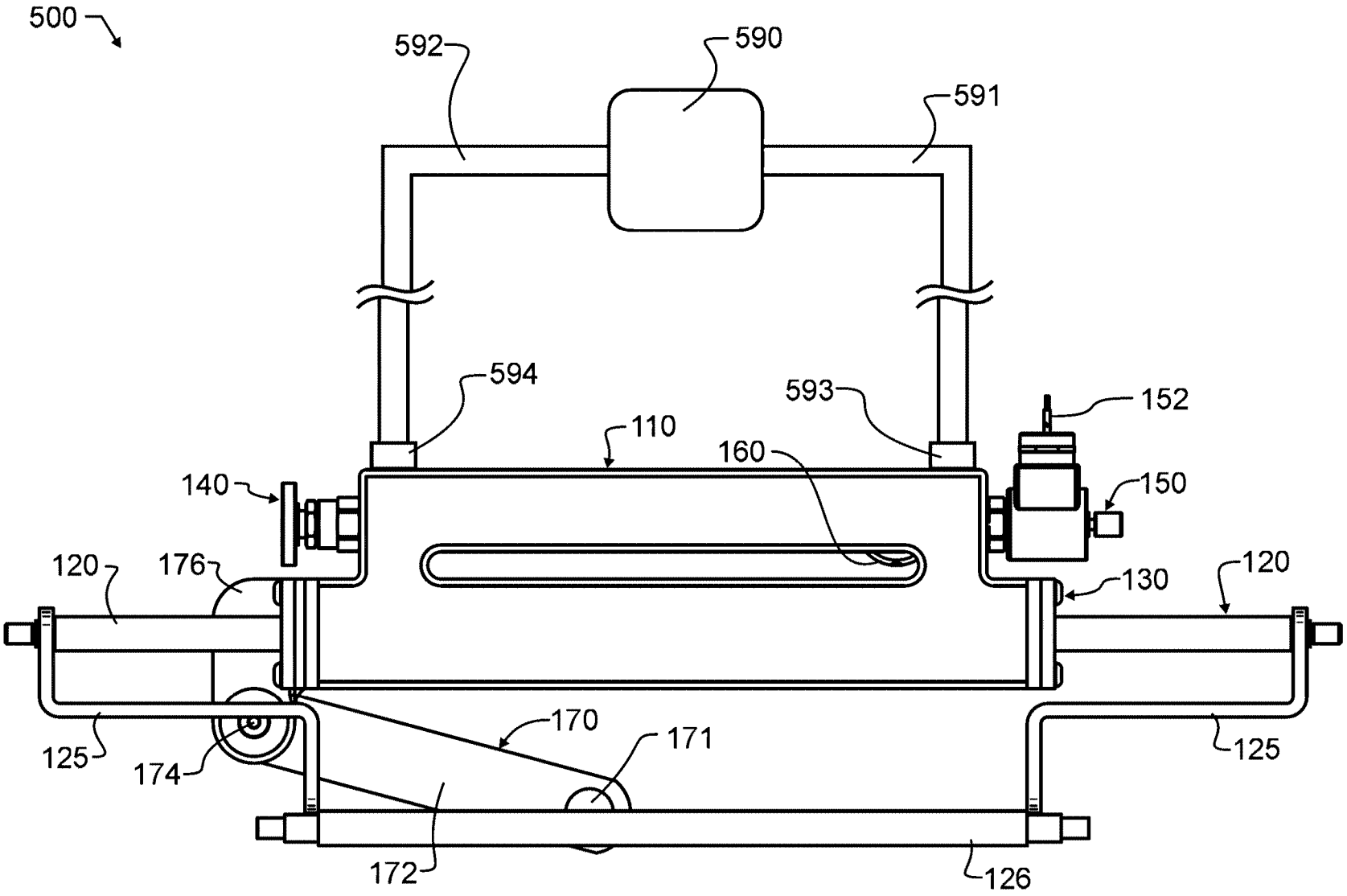
FIG. 18 illustrates a third alternative embodiment tiller assist designed in accord with the teachings of the present invention from a bottom view.
Figure 19:
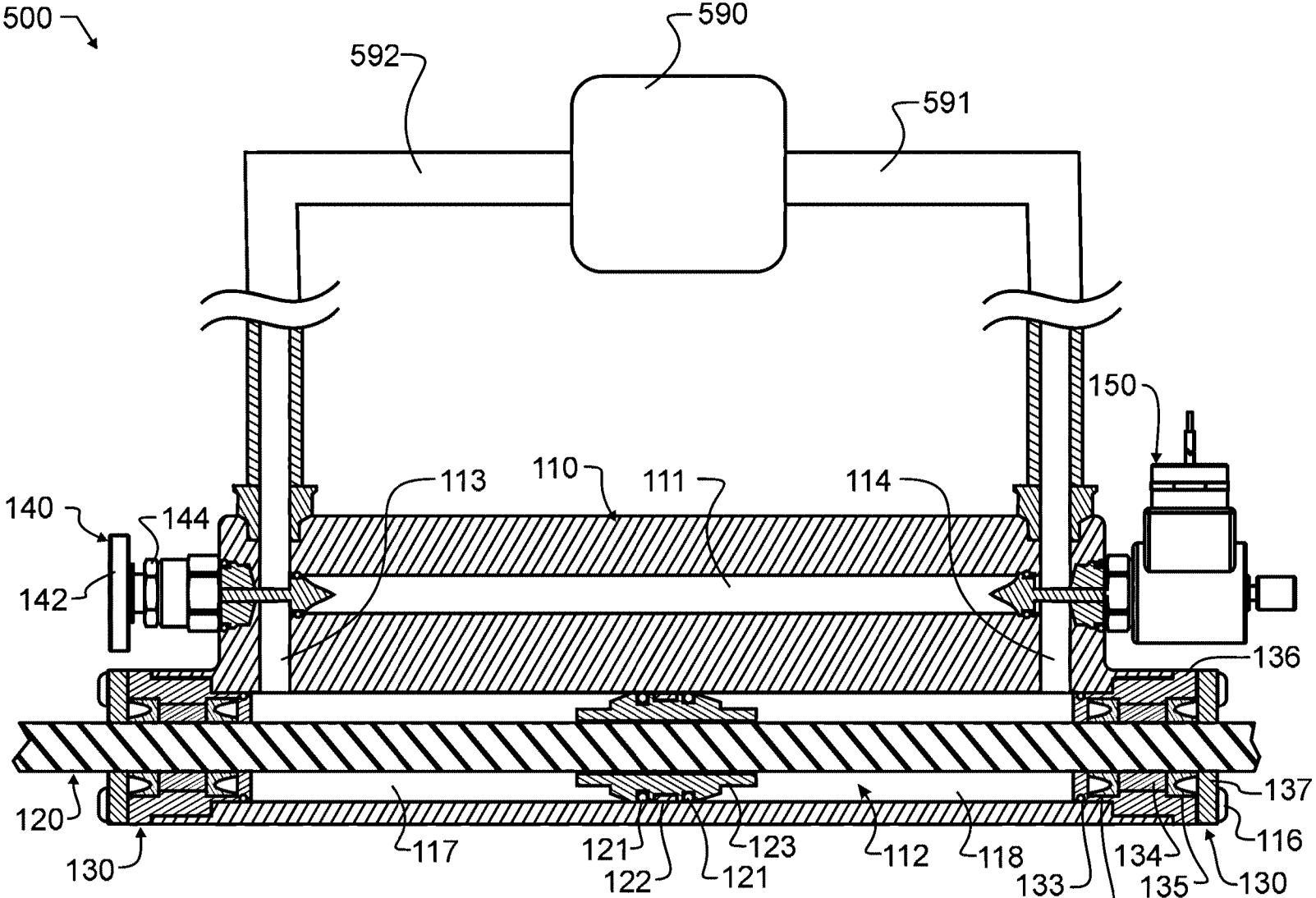
FIG. 19 illustrates the third alternative embodiment tiller assist from FIG. 18 taken from a horizontal plane section view similar to that of FIG. 3.

FIGS. 18 and 19 illustrates a third alternative embodiment tiller assist 500. As visible in FIG. 18, caps 115 have been removed, exposing the two transverse passages 113 and 114. In place of caps 115, a pair of hydraulic fittings 593, 594 are provided that couple transverse passages 113 and 114 to hydraulic lines 591, 592, and ultimately to hydraulic pump and controls 590, as best visible in FIG. 19. Hydraulic pump and controls 590 is configured to selectively pump hydraulic fluid in either direction. Hydraulic line 591 will be used as an inlet and hydraulic line 592 as an outlet when pumping is selected in a first direction, and hydraulic line 592 will be used as an inlet and hydraulic line 591 as an outlet when pumping is selected in a second direction opposite to the first direction. Most preferably, hydraulic pump and controls 590 will be configured to either be actively pumping hydraulic fluid, or present a closed fluid path that does not permit any fluid to pass there through. A suitable and exemplary but non-limiting hydraulic pump and controls 590 is illustrated in my application Ser. No. 62/649,927 incorporated by reference herein above, though with the present description those skilled in the hydraulics arts will readily determine available alternatives thereto.

As may be understood then, manifested in the preferred and alternative embodiment tiller assists 100, 500, the present invention provides a closed loop hydraulic tiller assist that enables a tillerman to selectively introduce controlled resistance to movement of the tiller. This is achieved through adjustment of hydraulic needle valve 140 when solenoid valve 150 is open. In addition, the tillerman may selectively lock the tiller in a particular position by closing either or both of hydraulic needle valve 140 and solenoid valve 150. In the case of third alternative embodiment tiller assist 500, the tillerman may further selectively engage a power steering system to replace manual steering.

Hydraulic pump and controls 590 will most preferably be configured to either be actively pumping hydraulic fluid, or present a closed fluid path that does not permit any fluid to pass there through. By so configuring, when either or both of hydraulic needle valve 140 and solenoid valve 150 are closed, and hydraulic pump and controls 590 is not pumping, then tiller assist 500 will lock the tiller handle in place. However, with either or both of hydraulic needle valve 140 and solenoid valve 150 closed, when hydraulic pump and controls 590 is pumping then tiller assist 500 will be driven in the direction of fluid movement within central bore 112.

In other words, since no fluid can pass through primary bypass passage 111, fluid being pumped out of hydraulic pump and controls 590 through hydraulic line 592 will enter into chamber 117. At the same time, fluid is being withdrawn through hydraulic line 591 from chamber 118. As a result, cylinder piston 123 will be driven toward hydraulic line 591.

The provision of hydraulic needle valve 140 in combination with hydraulic pump and controls 590 creates one additional adjustment that may be optionally made available to the tillerman. By opening solenoid valve 150, and then adjusting hydraulic needle valve 140 in an at least partially open position, hydraulic needle valve 140 will allow limited bypass of hydraulic fluid being pumped by hydraulic pump and controls 590. In such case, the fluid bypass will reduce the amount of fluid driving cylinder piston 123 to one side or the other, thereby slowing down the rotation of the tiller. Using this adjustment, the tillerman may further control the responsiveness of the power steering system.

From the foregoing figures and description, several additional features and options become more apparent. First of all, a tiller assist designed in accord with the present invention may be manufactured from a variety of materials, including metals, resins and plastics, ceramics or cementitious materials, or even combinations, laminates, or composites of the above. The specific material used may vary, though special benefits are attainable if several important factors are taken into consideration. First, a preferred embodiment tiller assist may be used in a variety of wet and potentially saline environments. The materials used will preferably be durable for an intended application, and provide appropriate corrosion resistance. Further, there are a number of moving and sliding parts. Where platings or coatings are used, they will preferably withstand the movements and environment as well. Furthermore, it is preferable that all materials are sufficiently tough and durable to not fracture, even when great forces are applied thereto.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A tiller assist adapted to couple between a boat transom and a boat motor steering connector, comprising:

a cylinder carriage defining a cylinder passage;

a cylinder piston adapted to reciprocate within said cylinder passage and dividing said cylinder passage into first and second chambers;

a first one of said cylinder carriage and said cylinder piston adapted to be affixed to said boat transom, and a second one of said cylinder carriage and said cylinder piston different from said first one adapted to be affixed to said boat motor steering connector;

a first fluid path coupling said first chamber to said second chamber;

at least one normally open valve provided within said first fluid path intermediate between said first and second chambers having a first closed position adapted to block flow through said first fluid path, and a second open position adapted to provide substantially unrestricted flow;

at least one first fluid path flow restrictor provided within said first fluid path intermediate between said first and second chambers and in series with said at least one normally open valve and configured to restrict flow through said first fluid path;

a second fluid path coupling said first chamber to said second chamber;

a fluid pump provided within said second fluid path intermediate between said first and second chambers having a first inoperative state blocking said fluid from flowing through said second fluid path and a second state pumping a fluid through said second fluid path.

2. The tiller assist of claim 1, wherein said first fluid path further comprises:

a primary bypass passage within said cylinder carriage and generally parallel to and separated from said cylinder passage;

a first transverse passage within said cylinder carriage coupling said first chamber to a first end of said primary bypass passage; and a second transverse passage within said cylinder carriage coupling said second chamber to a second end of said primary bypass passage.

3. The tiller assist of claim 2, wherein said second fluid path further comprises:

a first fluid line coupled to said fluid pump;

a first removable fitting coupling said first fluid line to said first transverse passage;

a second fluid line coupled to said fluid pump; and a second removable fitting coupling said second fluid line to said second transverse passage.

4. The tiller assist of claim 1, wherein said at least one flow restrictor amount of flow restriction is selectively set from a plurality of available flow rates intermediate between blocked and unrestricted flow.

5. The tiller assist of claim 1, wherein said at least one flow restrictor further comprises a hydraulic needle valve and said at least one valve further comprises a normally open electrical valve.

6. The tiller assist of claim 5, wherein said at least one flow restrictor further comprises a manual adjustment knob adapted to secure a flow restriction setting.

7. A tiller assist marine dampener and brake assembly, comprising:

a cylinder having first and second distal ends;

a piston reciprocal within said cylinder intermediate to and defining a fluid seal between said first cylinder end and said second cylinder end;

a tilt tube coupler adapted to securely engage an outboard motor tilt tube;

a transom coupler adapted to securely engage a boat transom;

a one of said tilt tube coupler and said transom coupler secured to said cylinder, and the other of said tilt tube coupler and said transom coupler secured to said piston;

a first fluid path external to said cylinder coupling said first cylinder end to said second cylinder end;

first and second valves in series with each other within said first fluid path and intermediate between said first cylinder end and said second cylinder end, configured in a first open state when said first valve and said second valve are both open to provide in combination with said first fluid path a continuous and substantially unrestricted path from said first cylinder end to said second cylinder end, and configured in a second closed state when at least one of said first and second valves are closed to interrupt said first fluid path between said first cylinder end and said second cylinder end, and configured in a third flow restricted state when said first valve is open and said second valve is partially closed to restricted flow in said first fluid path adapted to provide countering torque to rapid position changes of a boat motor, and thereby dampen movement of said boat motor induced by waves;

a second fluid path coupling said first chamber to said second chamber;

a fluid pump provided within said second fluid path intermediate between said first and second chambers having a first inoperative state blocking said fluid from flowing through said second fluid path and a second state pumping a fluid through said second fluid path.

8. The tiller assist marine dampener and brake assembly of claim 7, further comprising:

a unitary cylinder carriage defining said cylinder; and wherein said first fluid path further comprises:

a primary bypass passage within said cylinder carriage and generally parallel to said cylinder passage and separated therefrom;

a first transverse passage within said cylinder carriage and coupling said first cylinder end to a first end of said primary bypass passage; and a second transverse passage within said cylinder carriage and coupling said second cylinder end to a second end of said primary bypass passage.

9. The tiller assist marine dampener and brake assembly of claim 8, wherein said second valve further comprises a hydraulic needle valve and said first valve further comprises a normally open electrical valve.

10. The tiller assist marine dampener and brake assembly of claim 7, wherein said second fluid path further comprises:

a first fluid line coupled to said fluid pump;

a first removable fitting coupling said first fluid line to said first transverse passage;

a second fluid line coupled to said fluid pump; and a second removable fitting coupling said second fluid line to said second transverse passage.

11. The tiller assist marine dampener and brake assembly of claim 7, wherein said first valve further comprises an electrical valve and said second valve further comprises a hydraulic needle valve.

12. The tiller assist marine dampener and brake assembly of claim 11, wherein said second valve further comprises a manual adjustment knob adapted to secure a flow restriction setting.

13. The tiller assist marine dampener and brake assembly of claim 7, wherein said fluid path further comprises a fluid accumulator adapted to accumulate fluid when said fluid expands, and adapted to release said fluid when said fluid contracts.

* * * * *